US008739488B2

(12) United States Patent
Vakhnin

(10) Patent No.: US 8,739,488 B2
(45) Date of Patent: Jun. 3, 2014

(54) APPARATUS FOR SECURING CEILING PANELS

(76) Inventor: Yaakov Vakhnin, Rishon Lezion (IL)

( * ) Notice: Subject to any disclaimer, the term of this patent is extended or adjusted under 35 U.S.C. 154(b) by 0 days.

(21) Appl. No.: 13/578,610

(22) PCT Filed: Feb. 15, 2011

(86) PCT No.: PCT/IL2011/000161
§ 371 (c)(1),
(2), (4) Date: Aug. 20, 2012

(87) PCT Pub. No.: WO2011/101844
PCT Pub. Date: Aug. 25, 2011

(65) Prior Publication Data
US 2012/0304575 A1 Dec. 6, 2012

(30) Foreign Application Priority Data

Feb. 16, 2010 (IL) ..... 203994
May 26, 2010 (IL) ..... 205989

(51) Int. Cl.
*E04B 9/24* (2006.01)

(52) U.S. Cl.
USPC ..... 52/506.09; 52/506.07; 52/506.06

(58) Field of Classification Search
USPC ..... 52/506.01, 506.06, 506.07, 506.08, 52/220.6, 220.7, 220.8, 144–145, 222, 52/656.1, 656.2, 273, 312
See application file for complete search history.

(56) References Cited

U.S. PATENT DOCUMENTS

| | | | | |
|---|---|---|---|---|
| 4,794,745 | A * | 1/1989 | Platt et al. | 52/506.07 |
| 4,848,054 | A * | 7/1989 | Blitzer et al. | 52/506.07 |
| 5,845,447 | A | 12/1998 | Bodine et al. | |
| 6,108,994 | A | 8/2000 | Bodine | |
| 6,260,325 | B1 | 7/2001 | Wendt | |
| 6,318,042 | B1 | 11/2001 | Bloom et al. | |
| 6,389,771 | B1 | 5/2002 | Moller | |
| 8,056,294 | B2 * | 11/2011 | LaLonde | 52/506.09 |
| 2002/0020126 | A1 | 2/2002 | Rebman | |
| 2003/0182894 | A1 | 10/2003 | Galsgaard et al. | |
| 2006/0064939 | A1 * | 3/2006 | Kelley et al. | 52/506.07 |
| 2006/0179765 | A1 | 8/2006 | Howard et al. | |
| 2008/0086962 | A1 | 4/2008 | Jahn et al. | |
| 2009/0173030 | A1 * | 7/2009 | Gulbrandsen et al. | 52/506.09 |

OTHER PUBLICATIONS

IPRP CH II of May 15, 2012—along with the Dec. 12, 2011 amendments that the IPRP is based on—28 pages.

* cited by examiner

*Primary Examiner* — Brian Glessner
*Assistant Examiner* — Beth Stephan
(74) *Attorney, Agent, or Firm* — Roach Brown McCarthy & Gruber, P.C.; Kevin D. McCarthy

(57) ABSTRACT

A ceiling panel assembly for being secured to, and for concealing, a suspended inverted T-shaped, longitudinally extending main runner having a vertically disposed web, a horizontally disposed flange divided by the web to equal flange portions, and a protuberance at a terminal end of each of the flange portions, which comprises: a main section with a first and second lateral edge and visible panel sections and two support sections laterally extending in opposite directions, which are disposed above the main section. The two support sections releasably contact two adjacent and laterally spaced main runners, respectively, and one of the sections is adapted to multi-directionally stiffen a corresponding main runner.

20 Claims, 23 Drawing Sheets

APPARATUS FOR SECURING CEILING PANELS

REFERENCE TO CO-PENDING APPLICATIONS

Priority is claimed as a 371 of international application number PCT/IL2011/000161, filed on Feb. 15, 2011; which claims priority to Israeli Patent application serial number 203994, filed on Feb. 16, 2010 and Israeli Patent application serial number 205989, filed on May 26, 2010.

FIELD OF THE INVENTION

The present invention relates to the field of ceiling panels. More particularly, the invention relates to an apparatus for securing ceiling panels.

BACKGROUND OF THE INVENTION

Ceiling panels such as acoustical ceiling panels are generally suspended on support members. This invention deals with the type of ceiling panels that esthetically conceal the support members when viewed from below.

Many ceiling panels that conceal the support members are known from the prior art; however, they are liable to be dislodged from the support members and to cause damage when falling from the ceiling.

U.S. Pat. No. 6,108,994 discloses a ceiling panel having first and second opposing edges having different profiles with upper and lower lips. The first edge has a registration step and an access kerf at a first level below the registration step. The second edge has a registration kerf formed by the upper and lower lips at a second level above the first level. When the panel is assembled into the ceiling, the access kerf permits the registration kerf to engage, and form a hinge with, the support grid. The registration kerf permits the panel to be shifted and rotated to engage the registration step with the grid.

This prior art panel is formed by a complicated and therefore costly method for precisely forming the lips and kerfs of the first and second edges, particularly when the panel is made from difficult to cut mineral fiber. An additional drawback of this panel is that the assembly and removal procedures are time consuming, for example an exploratory upward lift is needed to identify the first edge. Also, the panel is liable to be dislodged from the support grid when a random force is applied thereto. Furthermore, two adjacent panels are assembled with significant play therebetween, to take into account the complicated assembly and removal procedures, and therefore side edges of a plurality of assembled panels invariably will not be coplanar, detracting from the esthetic appearance of the ceiling.

Other prior art concealed ceiling panels with other or similar drawbacks are U.S. Pat. No. 6,260,325 and U.S. Pat. No. 6,389,771.

The Casoline GRID panel disclosed in www.british-gypsum.com is provided with metal support sections attached to the upper planar surface of the panel, for engaging the upper face of the flange of a support member generally referred to as a "main runner". The portions of the support sections that engage the main runner flange are substantially horizontally disposed. The disposition of the engaging portions, and consequently of the entire panel, is therefore dependent upon the disposition of the main runner. However, the main runner, which is generally made of thin-gauge sheet metal, e.g. of 0.4 mm thickness, and sensitive to applied loads, is supported by one or more hangars vertically extending from an overhead surface. Due to assembly inaccuracies, the hangars may not be positioned completely perpendicularly to the overhead surface and a panel supported by two adjacent main runners may be slightly oblique with respect to a neighboring panel as a result of the variance in perpendicularity of adjacent hangers that support a corresponding main runner from above. Thus the side edges of a plurality of assembled panels invariably will also not be coplanar, and adjacent side edges of laterally adjacent panels will not be mutually parallel, detracting from the esthetic appearance of the ceiling.

It is an object of the present invention to provide means for securing a ceiling panel in such a way that it will not be dislodged from adjacent concealed main runners during normal usage, yet is detachable from the main runners upon demand.

It is an additional object of the present invention to provide means for securing a ceiling panel such that the side edges of a plurality of assembled panels will be coplanar.

It is an additional object of the present invention to provide means for diminishing the influence of the hangar disposition on the disposition of the main runner flange and on the panel secured thereto.

Other objects and advantages of the invention will become apparent as the description proceeds.

SUMMARY OF THE INVENTION

The present invention provides a ceiling panel assembly for being secured to, and for concealing, a suspended inverted T-shaped, longitudinally extending main runner having a vertically disposed web, a horizontally disposed flange divided by said web to equal flange portions, and a protuberance at a terminal end of each of said flange portions.

The main runner, which is generally made of thin-gauge sheet metal and sensitive to applied loads, is suspended by one or more hangars vertically extending from an overhead surface. Due to assembly inaccuracies, the hangars may not be positioned completely perpendicularly to the overhead surface. The delicate main runner web tends to change its disposition while seeking the least stressed disposition, generally collinear or parallel with the imperfectly installed hangar. In contrast to prior art ceiling panel assemblies which are secured to the main runner flange and therefore become slightly oblique with respect to the underlying floor surface, and at times with respect to a neighboring panel, as a result of the variance in perpendicularity of adjacent hangers that support a corresponding main runner from above, the panel assembly of the present invention stiffens the main runner flange. A change in disposition of the stiffened main runner flange and of the panel assembly secured thereto is therefore resisted.

The panel assembly of the present invention comprises:

a) a main section with a first and second lateral edge and having one or more visible panel sections; and b) two support sections laterally extending in opposite directions, which are disposed above said main section, wherein said two support sections releasably contact two adjacent and laterally spaced main runners, respectively, and one of said sections is adapted to multi-directionally stiffen a corresponding main runner.

Preferably a first support section is a multi-directionally stiffening support section for stiffening, e.g. in four translational and in two rotational directions, and unforcibly contacting the flange of a first main runner overlying the main section of a first panel assembly and a second support section is a stabilizing support section for unforcibly contacting the flange of a second main runner multi-directionally stiffened by a second panel assembly laterally adjacent to said first panel assembly.

In one aspect, the multi-directionally stiffening support section comprises a flange abuttable element for engaging a flange portion of the first main runner when the stabilizing support section is raised, to prevent the panel assembly from falling through a ceiling opening.

In one aspect, the multi-directionally stiffening support section is connected to, or integral with, a planar flange-underlying element in unforcible contact with the first main runner flange.

In one aspect, one end of the flange-underlying element laterally extends from the first lateral edge of the main section.

In one aspect, the multi-directionally stiffening section comprises a protuberance-fastening element for unforcibly contacting substantially the entire outer surface of a flange portion protuberance. The protuberance-fastening element has substantially the same curvature as the protuberance. A spacer may be interposed between the protuberance-fastening element and the flange abuttable element.

In one aspect, the multi-directionally stiffening section comprises two elements vertically extending from the flange-underlying element, for unforcibly contacting a corresponding flange portion protuberance.

The flange abuttable element extends from, and is substantially perpendicular to, one of the vertically extending elements, and may extend between the two vertically extending elements.

In one aspect, the two support sections are connected to, or integral with, the one or more panel sections and the flange-underlying element is in abutting relation with a planar upper surface of the one or more panel sections.

In one aspect, the length of the main runner flange is substantially equal to that of the flange-underlying element.

In one aspect, the multi-directionally stiffening support section is dimensioned such that one flange portion of the first main runner overlies the first lateral edge of the main section of the first panel assembly and extends to the second lateral edge of a third panel assembly which is laterally adjacent to the first panel assembly to define a gap between the first lateral edge of the first panel assembly and the second lateral edge of the third panel assembly.

In one aspect, the first lateral edge of the first panel assembly and the second lateral edge of the third panel assembly are straight edges and the gap has a predetermined and uniform width, e.g. of less than 5 mm and preferably less than 2 mm, and all first lateral edges of each of a row of first panel assemblies are essentially coplanar and all second lateral edges of each of a row of third panel assemblies are essentially coplanar.

In one aspect, each of the one or more visible panel sections has a straight bottom edge and all bottom edges of each of a plurality of panel assemblies are essentially coplanar.

In one aspect, the flange abuttable element is spaced from the web of the first main runner by a distance of less than 5 mm, and preferably by a distance of approximately 2 mm, when the stabilizing support section unforcibly contacts the flange of the second main runner.

In one aspect, the stabilizing support section comprises a force appliable element extending from the second lateral edge of the first panel assembly and connected to, or integral with, the main section of the first panel assembly, for unforcibly contacting the protuberance of a flange portion of the second main runner. The force appliable element may be substantially perpendicular to the web of the second main runner.

In one aspect, the main section further comprises a frame member to which the one or more visible panel sections are attachable.

In one aspect, a portion of two adjacent panel sections attached to the frame member are separated by an opening constituting an air chamber through which sounds generated in a room are transmittable so as not to be reflected back into said room.

In one aspect, an ornamental element is attached or applied to one or more of the panel sections, such as attached to two adjacent panel sections.

The present invention is also directed to a frame member for ceiling panels comprising one or more connecting members for interfacing between two separate support sections which are contactable with two suspended members, respectively, and between one or more visible panel sections.

In one aspect, the one or more visible panel sections are attached to the one or more connecting members and are spaced from each other so as to define corresponding openings each of which constituting an air chamber through which sounds generated in a room are transmittable so as not to be reflected back into said room.

In one aspect, the frame member is rectangular and comprises four integrally formed connecting members.

In one aspect, the one or more connecting members support ceiling related apparatus.

DETAILED DESCRIPTION OF PREFERRED EMBODIMENTS

The present invention is a novel ceiling panel that is secured to, while stiffening, an adjacent concealed main runner, so that the side edges of a plurality of assembled panels will be coplanar. Thus an architectural effect can be achieved, which could not have been realized heretofore, whereby a gap of a predetermined and uniform width can be produced between adjacent rows of ceiling panels having coplanar side edges.

Figure 1:
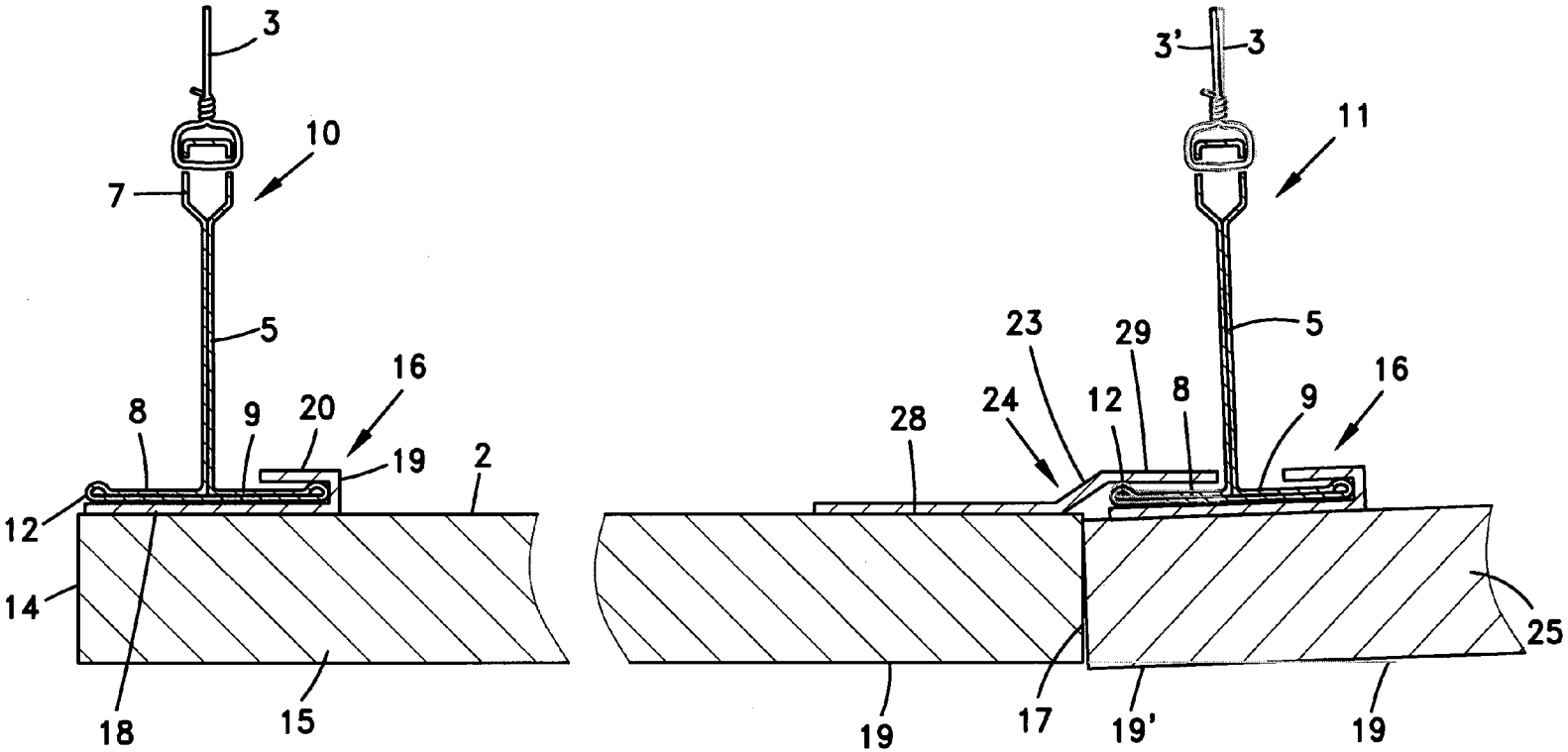
Fig. 1 Prior Art
FIG. 1 is a vertical cross sectional view of a ceiling panel and of prior art support sections for securing the panel to a suspended main runner.
Figure 11A:
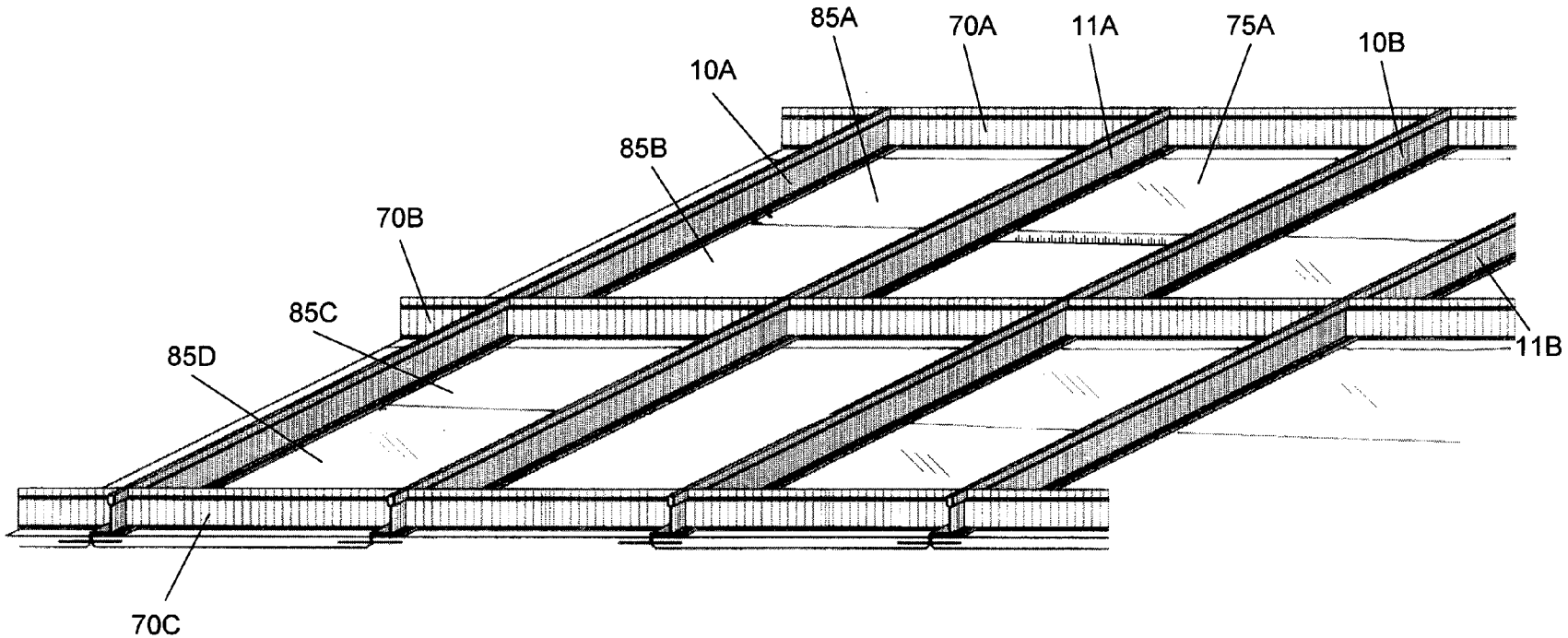
FIGS. 11A-D illustrate perspective views from above of a grid of main runners and cross runners, showing a longitudinal panel sliding operation.

The utility of the present invention will be appreciated by referring first to FIG. 1, which illustrates a prior art ceiling panel for concealing the main runners, which span a room and form a supporting grid together with cross runners beneath an overhead surface. A plurality of mutually parallel cross runners extend between, and strengthen, two adjacent and identical laterally spaced main runners, e.g. the illustrated main runners 10 and 11, and define the distance therebetween. A portion of a typical grid is shown in FIG. 11A.

A metal, inverted T-shaped main runner 10 has a generally vertically disposed web 5 terminating at its uppermost end with a hollow bulb 7 which is suspended from a plurality of hangars 3 attached to an overlying horizontal support surface 37 (FIG. 2), and a generally horizontally disposed flange divided by web 5 to equal flange portions 8 and 9. An oval protuberance 12 is provided at the outer end, i.e. separated from web 5, of the flange portions 8 and 9.

The dimensions of main runner 10 are standardized, e.g. the flange has a lateral dimension of 24 mm and the web has a vertical dimension of 45 mm. The web and flange are generally made of thin, two layered sheet metal. Each layer has a standard thickness of e.g. 0.4 mm, and main runner 10 is therefore easily deformed. The hangars 3 from which each main runner 10 is suspended may be separated by an equal distance of approximately 1.20 m. The lateral dimension between the webs of two suspended main runners is e.g. 61 cm and between two adjacent flanges is e.g. 58.5 cm.

To the planar and substantially horizontal upper surface 2 of prior art panel 15, generally made of a mineral fiber substrate, are adhesively attached metal support sections 16 and 24.

J-shaped support section 16, which is secured to flange portion 9 of main runner 10, has an inwardly extending planar element 18 that is adhesively attached to upper surface 12 of panel 15, adjacent to, and slightly separated from, lateral edge 14 of the panel. The length of element 18 is substantially equal to the length of the flange of main runner 10. A short, substantially vertical element 19 extends from the inward edge of element 18. Retaining element 20 substantially parallel to element 18 outwardly extends from vertical element 19 for a fraction of the length of element 18, which is sufficient to retain flange portion 9 of main runner 10 within the interior of support section 16 after support section 16 has been secured to flange portion 9 and protuberance 12 of flange portion 9 contacts vertical element 19.

Support section 24 has a planar element 28 inwardly extending from lateral edge 17 of panel 15 that is adhesively attached to upper surface 2 of panel 15, and an abutting element 29 vertically spaced from, and substantially parallel to, element 28. Abutting element 29 is positioned outwardly from lateral edge 17 of panel 15, and an oblique element 23 extends from planar element 28 to abutting element 29. Abutting element 29 is adapted to contact main runner 11, i.e. protuberance 12 of its flange portion 8 from above.

The plurality of hangers 3 are generally manually installed to the overlying horizontal support surface, and downwardly extend therefrom for a distance ranging from approximately 0.3-2 m. As the manual installation technique is subject to human error, many of the hangars are invariably not perfectly perpendicular to the overlying horizontal support surface and to the underlying horizontal floor surface, e.g. by a deviation of a few millimeters. Although bulb 7 is suspended from an imperfectly installed hangar 3 such that web 5 is at first essentially perfectly perpendicular to the overlying horizontal support surface, the web seeks the least stressed disposition, which may be collinear or parallel with the imperfectly installed hangar. Thus over the course of time, the bulb becomes repositioned due to the gravitational force, causing the flange of main runner to be slightly oblique with respect to the underlying floor surface. Alternatively or in addition, the main runner becomes deformed over the course of time.

An imperfectly installed hangar 3' is shown relative to an ideally mounted hangar 3, which is attempted to be mounted perpendicularly to the overlying horizontal support surface and indicated by phantom lines. The flange of main runner 11, which is shown to have changed disposition due to the imperfectly installed hangar 3', is secured to support section 16 of panel 25. The lateral spacing between the web of main runners 10 and 11 remains substantially equal due to the presence of the cross runners; however the disposition of at least a portion of web 5 of main runner 11 is forced to change in response to the lack of perpendicularity of hangar 3'. Although flange portion 9 of main runner 11 is secured to support section 16 of panel 25, protuberance 12 of flange portion 8 is unrestrained and therefore flange portion 8 of main runner 11 is free to move. As a result of an angular change in disposition of web 5 of main runner 11, flange portion 8 of main runner 11 also angularly changes its disposition by a significant angular change of greater than 1 mm, and sometimes of up to 5 mm, applying a force onto element 18 attached to panel 25 which causes the bottom surface 19' of panel 25 to be oblique with respect to the underlying floor surface. Since each hanger may be positioned at a different degree of perpendicularity, the bottom surface of each corresponding panel may assume a different orientation, resulting in an esthetically unpleasant and non-uniform appearance.

In contrast, a panel assembly of the present invention comprises two laterally spaced support sections, a first support section for multi-directionally stiffening the main runner flange made of thin-gauge sheet metal to prevent a change in disposition of the main runner, and a second support section for stabilizing the given panel assembly by applying a force onto the main runner flange of an adjacent panel assembly.

Figure 2:
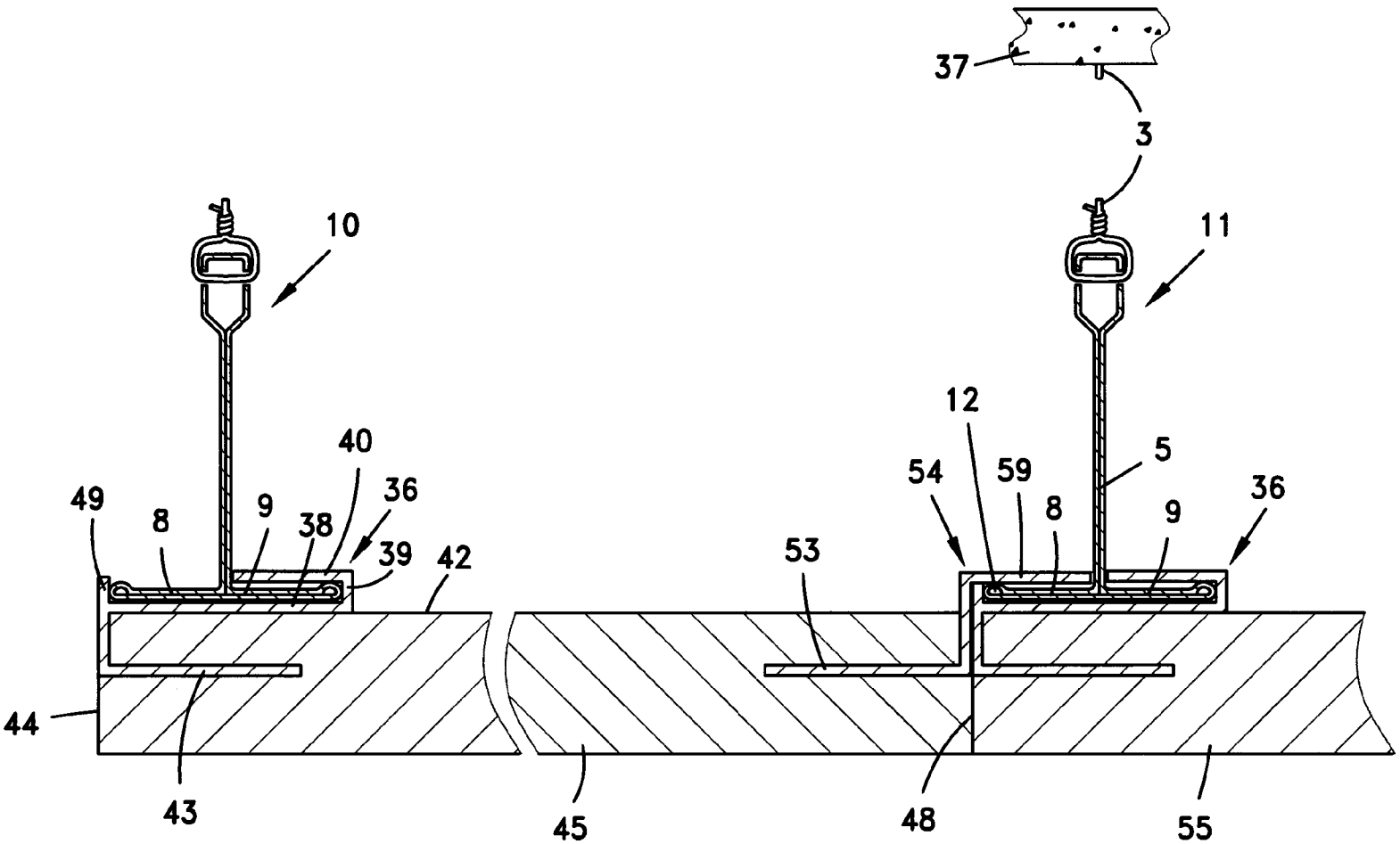
FIG. 2 is a vertical cross sectional view of a ceiling panel and of support sections according to one embodiment of the present invention for securing the panel to a suspended main runner.

Multi-directionally stiffening support section 36, which is shown in FIG. 2 according to one embodiment of the present invention and is secured to flange portion 9 of main runner 10, or of any other main runner, has an inwardly extending planar flange-underlying element 38 that extends along upper surface 42 of panel 45, from the vicinity of lateral edge 44 of the panel. Panel 45 may be made of mineral fiber or of any other suitable material. The length of flange-underlying element 38 is substantially equal to, and slightly greater than, the length of the main runner flange. Element 38 is attached to, or integral with, an L-shaped, or any other shaped, element 43, which is embedded within the panel. A first substantially vertical element 39 extends from the inward edge of element 38 and unforcibly contacts the protuberance of flange portion 9 from the side. As referred to herein, the term "unforcibly contacts" means that one element contacts another element, or is spaced by a sufficiently small clearance, e.g. 0.2 mm, that would result in contact if the flange begins to change its disposition; however, the pressure applied by two elements is sufficiently low to enable a longitudinal panel sliding operation, as will be described hereinafter. Element 40, which is adapted to abut and engage flange portion 9 when stabilizing support section 54 is raised, is substantially parallel to element 38 and outwardly extends from vertical element 39 to the vicinity of web 5. Flange abuttable element 40 unforcibly contacts the protuberance of flange portion 9 from above, to retain the latter within the interior of support section 36. A second substantially vertical element 49 of substantially the same length as first vertical element 39 extends from the outward edge of element 38 and unforcibly contacts the protuberance of flange portion 8 from the side.

As the main runner flange is unforcibly in contact with the two opposed vertical elements 39 and 49, and elements 39 and 49 have a considerably greater thickness than that of the main runner, e.g. of 1-mm thickness, support section 36 stiffens and strengthens the main runner flange. The strengthened main runner flange, or a main runner web portion, will not deform even though it is loaded by the weight of panel 45 and each flange portion will therefore remain in unforcible contact with the corresponding vertical element. Since each main runner flange unforcibly contacts a corresponding vertical element, substantial angular displacement of the main runner flange is prevented. The main runner flange is therefore considered to be "multi-directionally stiffened", meaning that substantial displacement thereof in different directions of greater than 1 mm is prevented as a result of the stiffening action provided by the support section. Support section 36 stiffens the main runner flange in the following directions, with respect to the illustrated orientation: (1) towards the right by means of first vertical element 39, (2) towards the left by means of second vertical element 49, (3) downwards by means of flange-underlying element 38, (4) upwards by means of flange-abuttable element 40, (5) clockwise by means of the combination of elements 38-40, and (6) counterclockwise by means of the combination of elements 38-40. Thus multi-directionally stiffening support section 36 prevents the main runner from changing its disposition in four translational and two rotational directions, even if hangar 3 lacks perpendicularity with respect to overlying horizontal support surface 37 with which it is connected and the web 5 seeks the least stressed disposition.

Since the main runners 10 and 11 are multi-directionally stiffened by the corresponding support section 36 and the multi-directionally stiffening support section is anchored within the corresponding panel, all panels are therefore also multi-directionally stiffened. By virtue of being multi-directionally stiffened, the adjacent lateral edges 48 and 44 of contiguous panels 45 and 55, respectively, are assured of remaining in an esthetically pleasing, mutually parallel configuration. In contrast, the adjacent, angularly displaceable lateral edges 17 and 14 of contiguous prior art panels 15 and 25 (FIG. 1), respectively, are not mutually parallel.

Stabilizing support section 54 is adapted to stabilize panel 45 by being positioned above, and unforcibly contacting, the flange portion associated with adjacent panel 55, and comprises a force appliable element 59 substantially parallel to the upper surface 42 of panel 45. Force appliable element 59 is attached to an L-shaped, or any other shaped, element 53, which is embedded within panel 45. Force appliable element 59 outwardly extends from lateral edge 48 of panel 45, overlying adjacent panel 55 contiguous with panel 45, and is adapted to unforcibly contact main runner 11, i.e. the protuberance 12 of its flange portion 8 from above. Due to the rectilinear configuration of support section 54, force appliable element 59 is also able to unforcibly contact vertical element 49 from above.

Figure 3:
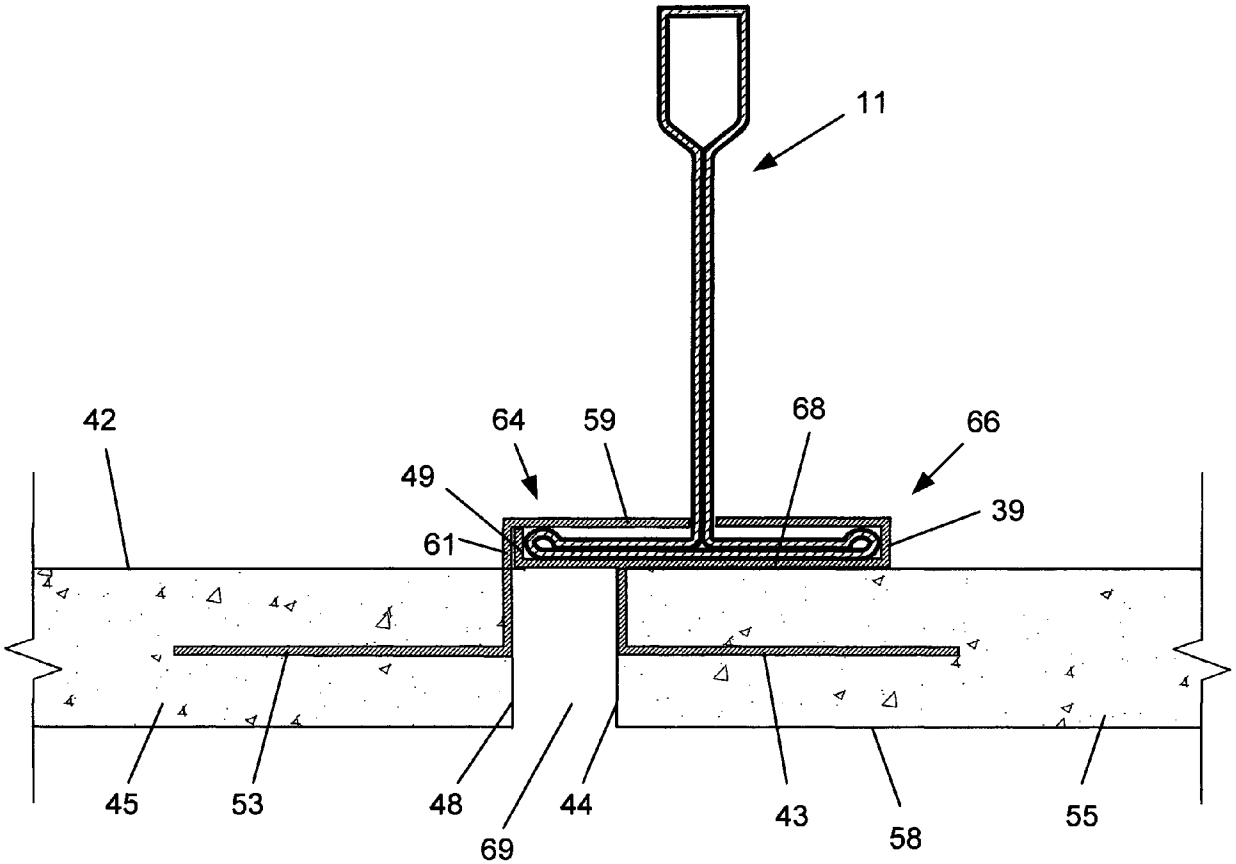
FIG. 3 is a vertical cross sectional view of support sections similar to those of FIG. 2 but adapted to provide a uniform gap between laterally adjacent panels.

In the embodiment of FIG. 3, planar flange-underlying element 68 of multi-directionally stiffening support section 66 extends outwardly from panel 55 in cantilevered fashion, allowing second vertical element 49 of angularly locking support section 66 to be spaced from lateral edge 44 of panel 55. Planar flange-underlying element 68 is in contact with upper surface 42 of panel 55 and extends between vertical elements 39 and 49. A central portion of element 68 is attached to anchor element 43, which is embedded within panel 55. Stabilizing support section 64 is attached to L-shaped anchor element 53, which is also embedded within panel 45. The vertical leg portion 61 of support section 64 that protrudes from the upper surface 42 of panel 45 is substantially collinear with lateral edge 48 of panel 45. Force appliable element 59 of support section 64 extends from vertical leg portion 61 to the vicinity of web 5 of main runner 11. By virtue of the spaced second vertical element 49 and the angularly locking support section 66, a gap 69 of uniform width is produced between panels 45 and 55. Since the main runners are multi-directionally stiffened by the corresponding support section 66 and the multi-directionally stiffening support section is anchored within the corresponding panel, all panels are therefore also multi-directionally stiffened and therefore their bottom visible surface 58 will be assured of remaining essentially coplanar.

Figure 4:
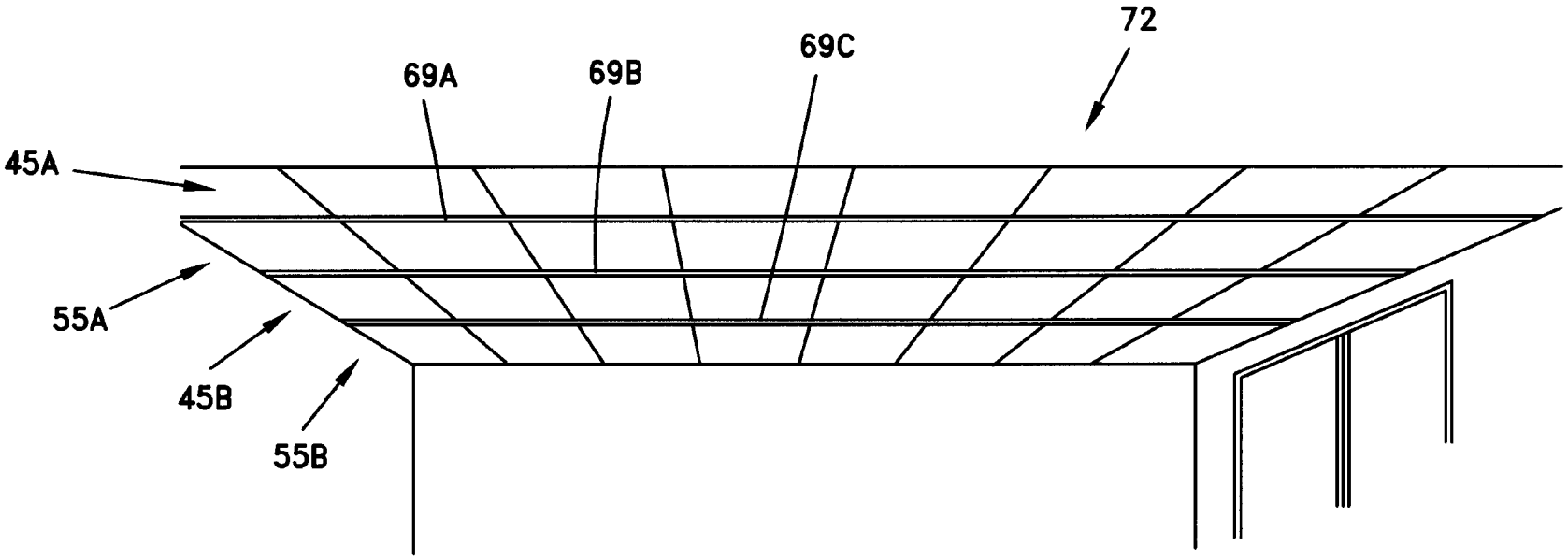
FIG. 4 is a perspective view from below of a panel system, showing a predetermined and uniform gap between each pair of adjacent panel rows.

A panel system 72 assembled according to the teachings of the present invention is illustrated in FIG. 4. The visible surface of all panels are essentially coplanar, and all main runners and cross runners are concealed by the panel rows 45A-B and 55A-B by use of support sections located above the upper edge of the panels, as described hereinabove. In each row, longitudinally adjacent panels are brought in abutting relation with each other. When the multi-directionally stiffening support sections 64 and 66 illustrated in FIG. 3 are employed, a gap 69A-C of a predetermined and uniform width is produced between two adjacent panel rows. Also, the corresponding lateral edges of all panels in a row that border a given gap are essentially coplanar. Thus visible and precisely dimensioned gaps extending throughout the room of a predetermined width can be achieved, providing an architectural effect that is suggestive of orderliness. While the angular deviation of longitudinally adjacent lateral edges of prior art angularly displaceable panels may not be noticeable when a gap is greater than approximately 8 mm, the angular deviation is noticeable and esthetically displeasing when the gap is less than this value. By employing multi-directionally stiffening support sections, a predetermined and esthetically pleasing uniform gap of less than 5 mm, e.g. 2 mm, between adjacent panel sections of the present invention may be advantageously provided.

Figures 5A, 5B:
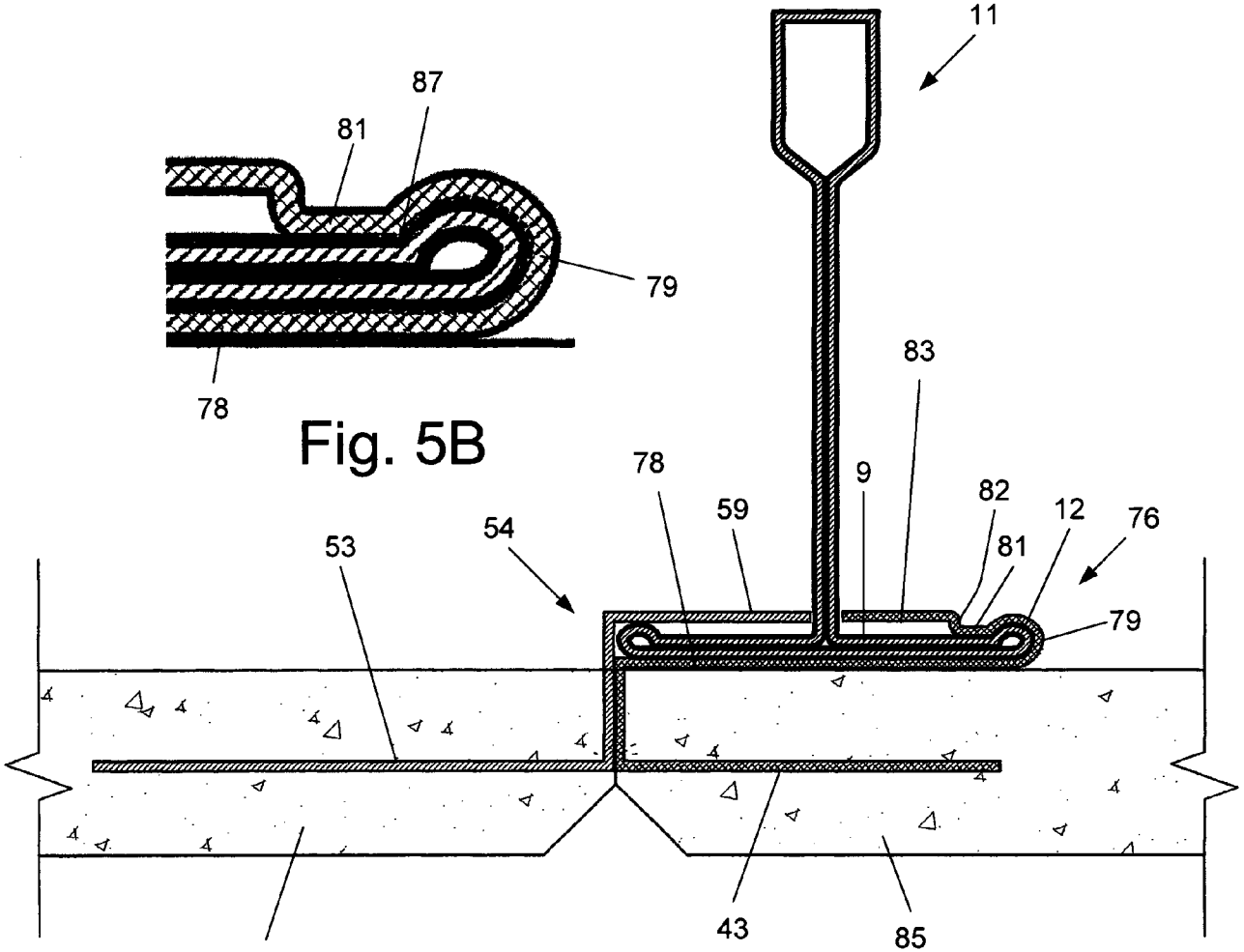
FIG. 5A is a vertical cross sectional view of a ceiling panel and of support sections according to another embodiment of the present invention.
FIG. 5B is an enlarged view of FIG. 5A, showing protuberance-fastening and translation-limiting elements.

In the embodiment of FIGS. 5A-B, multi-directionally stiffening support section 76 in configured with a clip that is fitted over the corresponding main runner flange portion. The clip comprises a protuberance-fastening element 79 that has the same curvature as protuberance 12 of flange portion 9 and is dimensioned such that its entire inner surface unforcibly contacts the entire outer surface of protuberance 12. Planar flange-underlying element 78, the length of which is substantially equal to the length of the main runner flange, tangentially and laterally extends from one arcuate end of protuberance-fastening element 79 and terminates with the lateral edge of panel 85 and with the embedded L-shaped anchor element 43. A short planar translation-limiting element 81, which is substantially parallel to, and unforcibly contacts, flange portion 9, laterally extends from, and is positioned outwardly with respect to, the second arcuate end of element 79. A spacer 82 obliquely extends upwardly from element 81 to planar flange-abuttable element 83, so as to be substantially collinear with force appliable element 59 of support section 54, which is connected to L-shaped anchor element 53 embedded within panel 75 contiguous with panel 85.

This clip configuration provides spring-like properties to allow flexibility during a ceiling panel securing operation, as will be described hereinafter. Thus protuberance-fastening element 79 and translation-limiting element 81 are able to cling to protuberance 12 so as to strengthen and stiffen the flange of main runner 11 while providing a multi-directionally stiffening action in the following directions, with respect to the illustrated orientation: (1) towards the right by means of protuberance-fastening element 79, (2) towards the left by means of discontinuity 87 between protuberance-fastening element 79 and translation-limiting element 81, (3) downwards by means of flange-underlying element 78, (4) upwards by means of protuberance-fastening element 79 and translation-limiting element 81, (5) clockwise by means of protuberance-fastening element 79, and (6) counterclockwise by means of protuberance-fastening element 79. Thus multi-directionally stiffening support section 76 prevents the main runner from changing its disposition in four translation and two rotational directions. The elements of support sections 54 and 76 are nevertheless configured with sufficient clearance with respect to corresponding elements of main runner 11, e.g. 0.2 mm, to enable a longitudinal panel sliding operation, as will be described hereinafter.

Figure 5C:
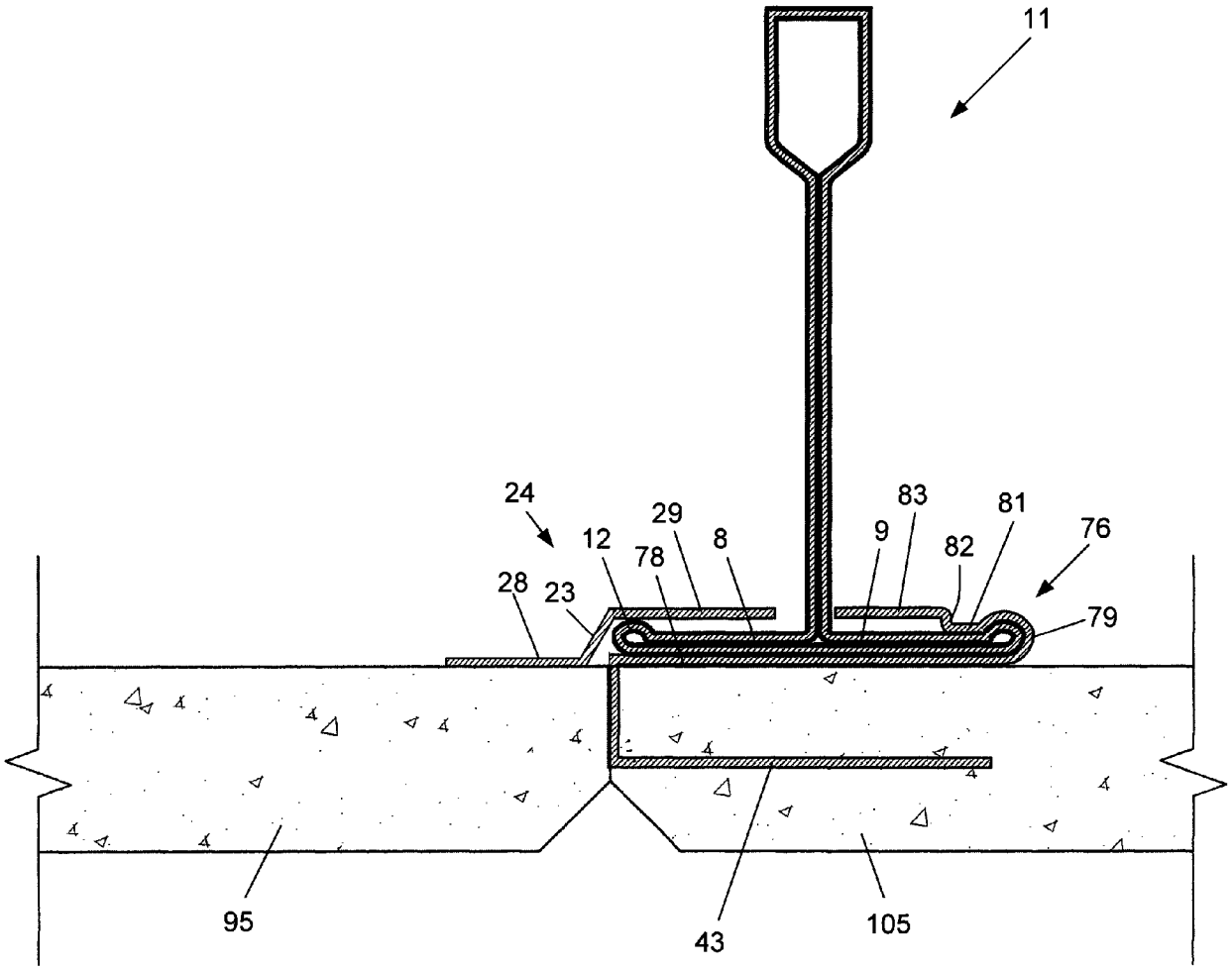
FIG. 5C is a vertical cross sectional view of a ceiling panel and of support sections according to another embodiment of the present invention.

In FIG. 5C are illustrated panel assemblies 95 and 105 which comprise multi-directionally stiffening support section 76 shown in FIG. 5A and stabilizing support section 24 shown in FIG. 1. It will be appreciated that any other type of stabilizing support section may be employed in conjunction with a multi-directionally stiffening support section having a protuberance-fastening element or two spaced vertical elements insofar as it applies a stabilizing force onto flange portion 8 or to its protuberance 12.

Figure 6:
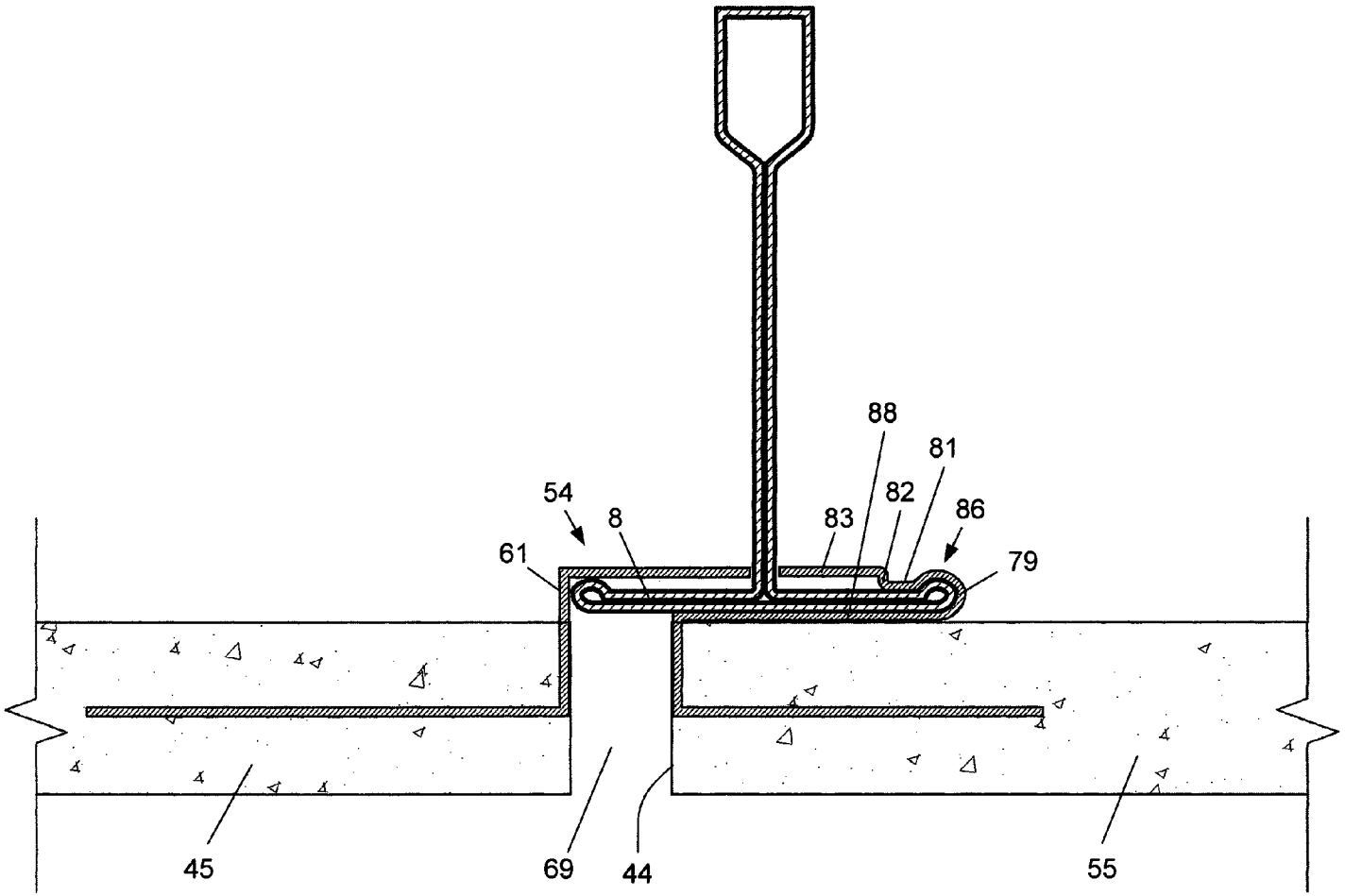
FIG. 6 is a vertical cross sectional view of support sections similar to those of FIG. 5A but adapted to provide a uniform gap between laterally adjacent panels.

In FIG. 6 is shown multi-directionally stiffening support section 86, which comprises a clip having protuberance-fastening element 79, translation-limiting element 81, spacer 82, and flange-abuttable element 83, and a planar flange-underlying element 88 extending along the upper surface of panel 55 from lateral edge 44 to protuberance-fastening element 79 and having a length less than that of the main runner flange. Since flange portion 8 laterally protrudes from panel 55 to the vicinity of vertical leg portion 61 of support section 54 that vertically protrudes from the upper surface 42 of panel 45, a gap 69 of uniform width is defined between panels 45 and 55.

The visible panel section of the present invention may be produced from any desired material or materials, including mineral fiber, fiberglass, wood, metal, plastic, plaster, and any combination thereof. The panel sections and support sections are suitably configured so as to conceal the main runners and cross runners. The panel sections may also be acoustic panels for sound absorption or sound insulation.

Figure 7:
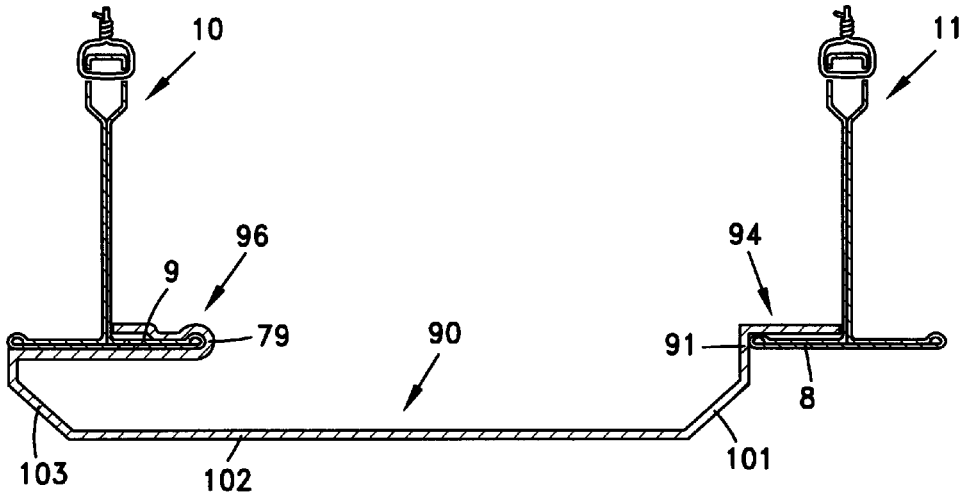
FIG. 7 is a vertical cross sectional view of a panel assembly made of sheet metal which comprises integral support sections similar to those of FIG. 5A.

FIG. 7 illustrates a panel assembly 90 made of sheet metal that comprises integral support sections 94 and 96, which are configured similarly to support sections 54 and 76, respectively, illustrated in FIG. 5A. Each main runner flange is releasably contacted by two adjacent panel assemblies 90. That is, flange portion 8, e.g. of main runner 11, is unforcibly contacted by vertical element 91 of stabilizing support element 94, and flange portion 9, e.g. of main runner 10, is unforcibly contacted by protuberance-fastening element 79 of multi-directionally stiffening support section 96. Symmetrical oblique elements 101 and 103 may extend from the two lateral ends of planar panel assembly bottom surface 102 to support sections 94 and 96, respectively.

It will be appreciated that the support sections of any embodiment described herein may be made of other suitable materials as well, such as metal, wood and plastic materials, whether integral with the panel assembly or attached thereto.

Figure 8A:
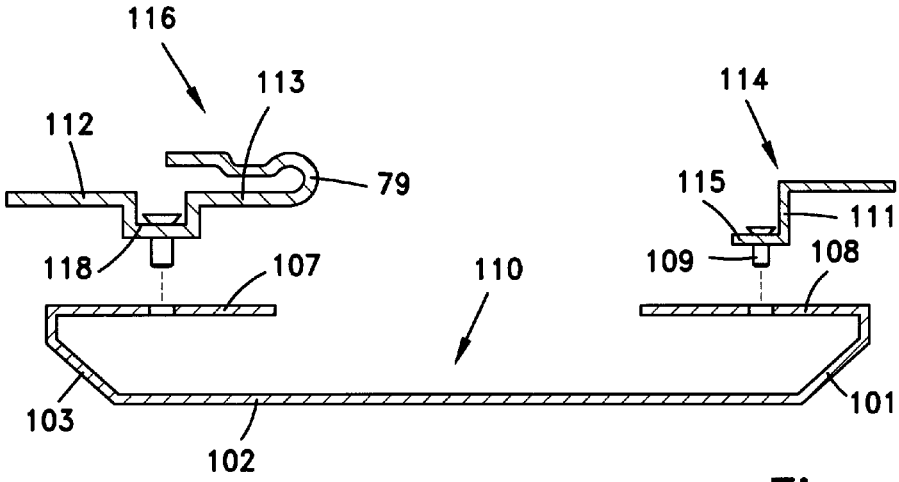
FIG. 8A is a vertical cross sectional view of a panel assembly having a main section similar to that of FIG. 7 but comprising attachable support sections.

FIG. 8A illustrates a panel assembly 110 made of sheet metal that comprises attachable support sections 114 and 116, which are configured similarly to support sections 94 and 96, respectively, illustrated in FIG. 7. One flange portion is unforcibly contacted by vertical element 111 of support section 114 and the other flange portion is unforcibly contacted by protuberance-fastening element 79 of support section 116. Support sections 114 and 116 are attachable to a main section, which includes spaced and collinear contact surfaces 107 and 108 that are disposed above, and parallel to, bottom surface 102. A corresponding fastening element 109, e.g. a threadedly connected fastener such as a bolt, connects the bottom planar surface 115 of support section 114 to contact surface 108 and the bottom planar surface 118 of support section 116 to contact surface 107. Bottom planar surface 118 of support section 116 may be recessed from spaced flange-underlying planar elements 112 and 113. Flange-underlying element 112 is preferably laterally spaced from the flange-abuttable element of support section 116, to accommodate positioning of the main runner web.

Figure 8B:
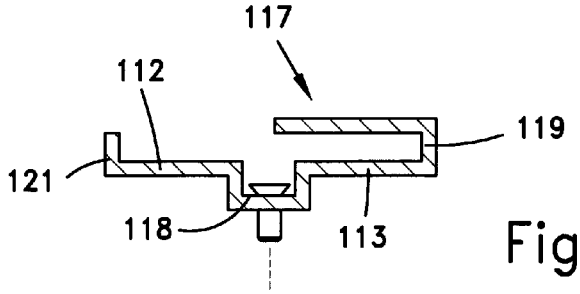
FIG. 8B is a vertical cross sectional view of a multi-directionally stiffening support section similar to that of FIG. 2 which is attachable to the main section of FIG. 8A.

In FIG. 8B is shown a multi-directionally stiffening support section 117, which is configured similarly to support section 36 of FIG. 2, i.e. with two vertical elements 119 and 121, and attachable to contact surface 107 shown in FIG. 8A.

Figure 9:
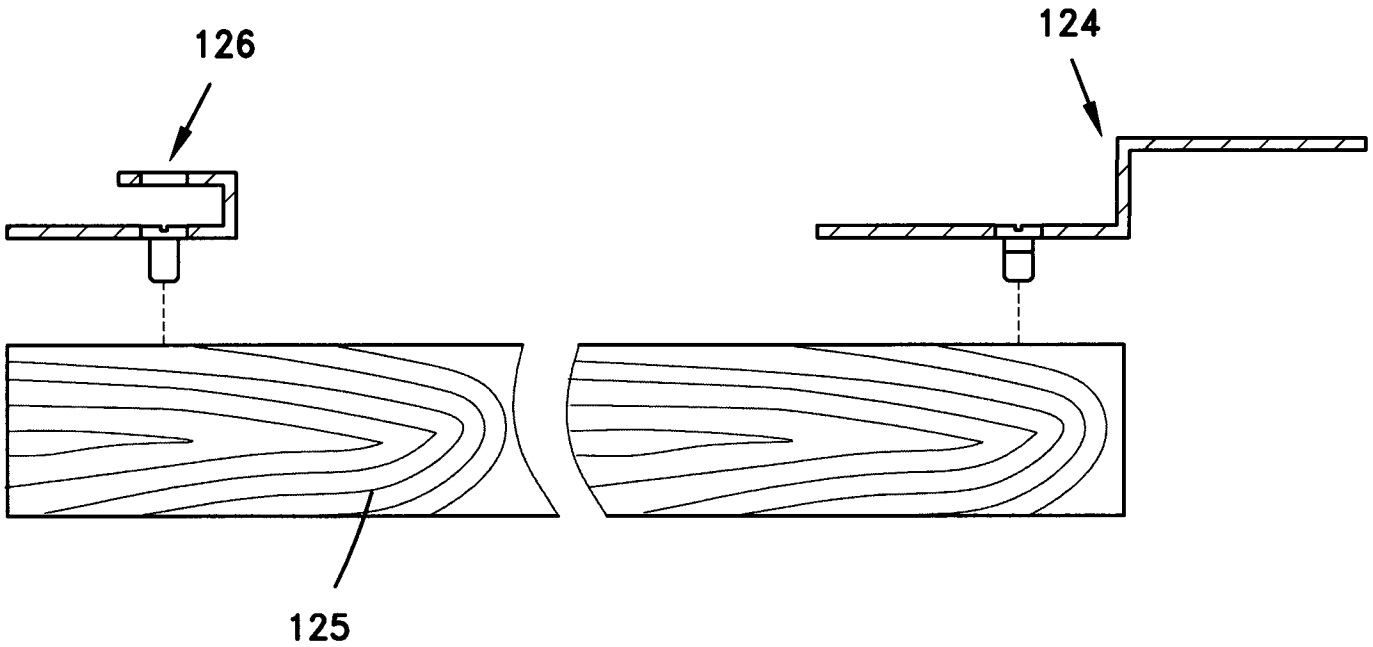
FIG. 9 is a vertical cross sectional view of a panel section made of wood to which is attachable two support sections.

FIG. 9 illustrates a wooden panel 125 to which is attachable support sections 124 and 125, which are configured similarly to support sections 54 and 36, respectively, illustrated in FIG. 2. An attachable support section may be attached to a panel section by any means known to those skilled in the art, including adhesion and by means of a fastening element.

Figure 10:
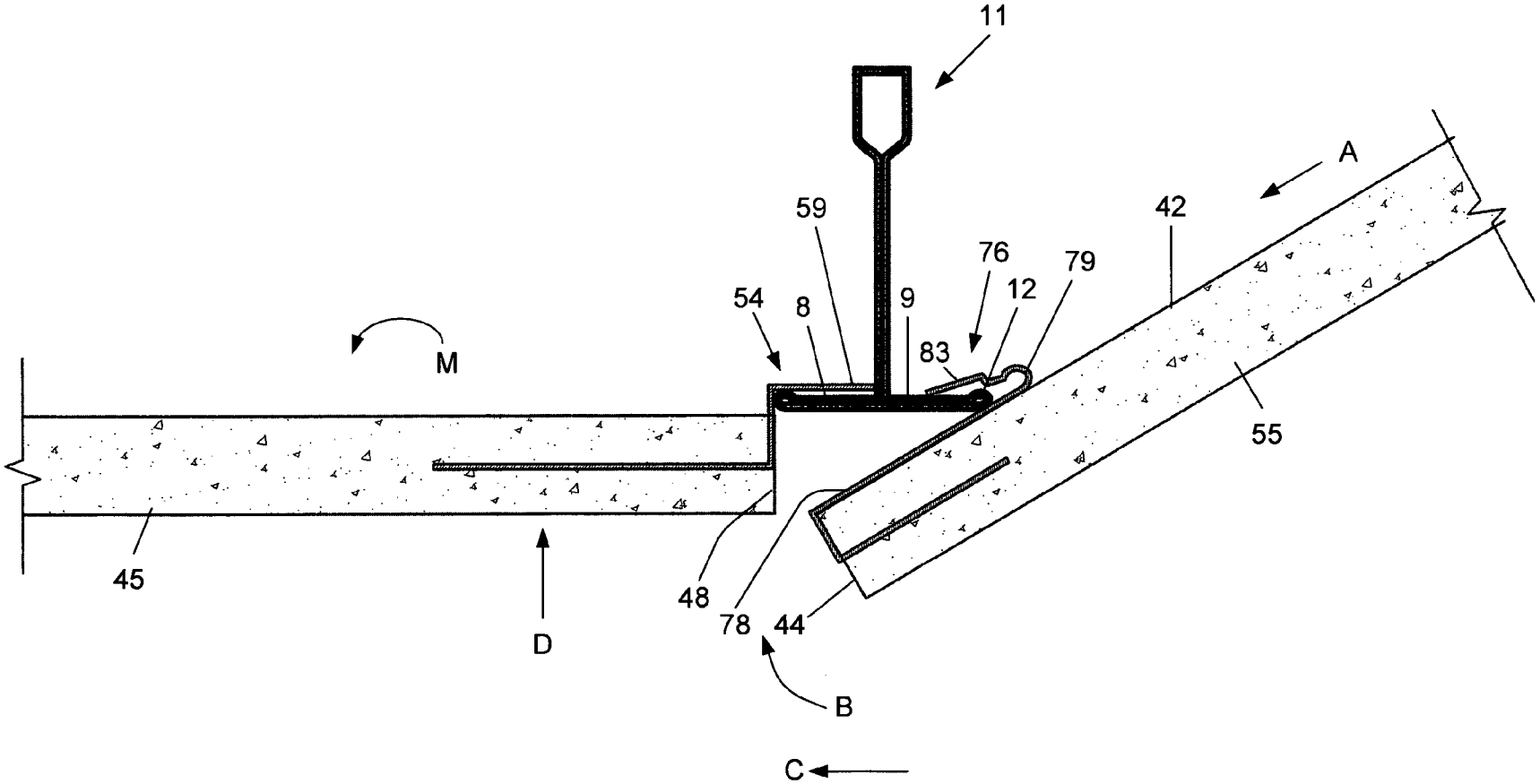
FIG. 10 is a vertical cross sectional view of a raised panel assembly while its flange abuttable element engages a first flange portion of the main runner and the force applicable element of a laterally adjacent panel assembly unforcibly contacts a second flange portion of the main runner.

A ceiling panel securing operation is illustrated in FIG. 10. Prior to securing panel 55 to main runner 11, panel 55 is obliquely positioned such that its upper planar surface 42 is disposed above the flange of main runner 11, without interfering with an adjacent main runner, and support section 76 is positioned in the vicinity of flange portion 9 of main runner 11. Panel 55 is then displaced in direction A, substantially parallel to upper surface 42, until planar flange-abuttable element 83 of the clip engages flange portion 9. Due to the flexibility of the clip, flange-abuttable element 83 is caused to be separated from flange-underlying element 78, forming a temporary acute angle therebetween. After the clip is engaged with flange portion 9, panel 55 is rotated in direction B towards main runner 11 until flange-underlying element 78 of support section 76 contacts flange portion 8 of main runner 11. In order to cause the main runner flange to be multi-directionally stiffened, panel 55 is then laterally displaced in direction C until protuberance 12 of flange portion 9 becomes unforcibly in contact with protuberance-fastening element 79 and panel 55 is brought substantially in contact with panel 45.

In order to remove a single panel, e.g. panel 45, the above steps are reversed. That is, panel 45 is first partially raised by applying a force D at its underside in the vicinity of support section 54, to separate force-appliable element 59 of support section 54 from the protuberance of flange portion 8 of main runner 11. Moment M acting on panel upper surface 42 as a result of applied force D is greater than the counteracting moment applied by protuberance-fastening element 79, which is normally sufficiently high to retain panel 45 in a horizontal disposition. Due to moment M, however, protuberance-fastening element 79 of panel 45 becomes separated from protuberance 12 of flange portion 9 and panel upper surface 42 assumes an oblique disposition. Upon a change in disposition of panel 45 while force D continues to be applied, the flange-abuttable element 83 of panel 45 engages flange portion 9 while the angle between flange-abuttable element 83 and the corresponding flange-underlying element 78 continuously increases.

Although panel 45 is obliquely disposed, it is prevented from falling to the underlying floor surface by virtue of the engagement between flange-abuttable element 83 and flange portion 9. In order to ensure that panel 45 will be prevented from falling through the opening in the ceiling when most of the panel is lifted above the main runner flange, the length of flange-abuttable element 83 extending from spacer 82 (FIG. 6) is sufficiently long so that it will contact flange portion 9 when the panel is obliquely disposed. At a sufficiently large angle between flange-abuttable element 83 and flange-underlying element 78, flange-abuttable element 83 is able to be separated from flange portion 9 and lateral edge 44 of panel 45 is able to be raised above flange portion 9, whereupon the panel is lowered through the opening formed by the removed panel.

A longitudinal panel sliding operation is illustrated in FIGS. 11A-D. Since the multi-directionally stiffening support sections 76 and the stabilizing support sections 54 (FIG. 5) unforcibly contact the flange of corresponding main runners, e.g. main runners 10A-B and 11A-B, and are located above the panels, e.g. panels 85A-D, the panels are advantageously able to pass below the cross runners, e.g. cross runners 70A-C when longitudinally displaced.

In FIG. 11A, panel 75A positioned between main runners 11A and 10B is shown to be adjacent to cross runner 70A. While panel 75A is in a horizontal disposition, it is able to be longitudinally displaced towards cross runner 70C while continuing to unforcibly contact main runners 11A and 10B. Alternatively, panel 75A may be longitudinally displaced when its stabilizing support section is raised and the flange-abuttable element of its multi-directionally stiffening support section 76 continues to engage flange portion 9 as shown in FIG. 10.

Figure 11B:
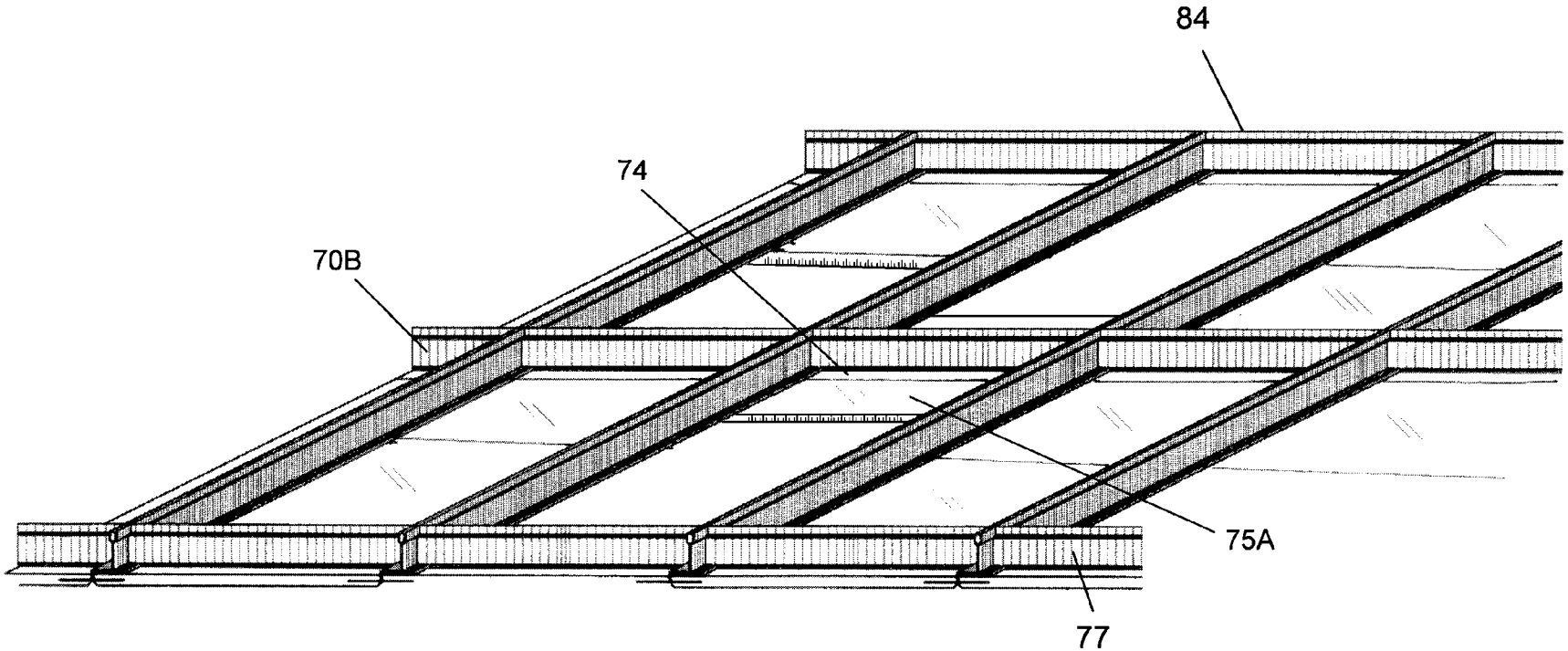

In FIG. 11B, panel 75A is shown to have passed below cross runner 70B. The support sections of panel 75A to do not interfere with cross runner 70B since the cross runner flange 74 and a lower portion of the cross runner web 77 may be removed for a predetermined distance at each lateral side, i.e. in the direction between two main runners, of a junction 84 connecting a main runner and a cross runner, to define a gap. Thus each support section of the panel 75A being longitudinally displaced, which is suitably dimensioned, will pass through a corresponding gap of junction 84.

Figure 11C:
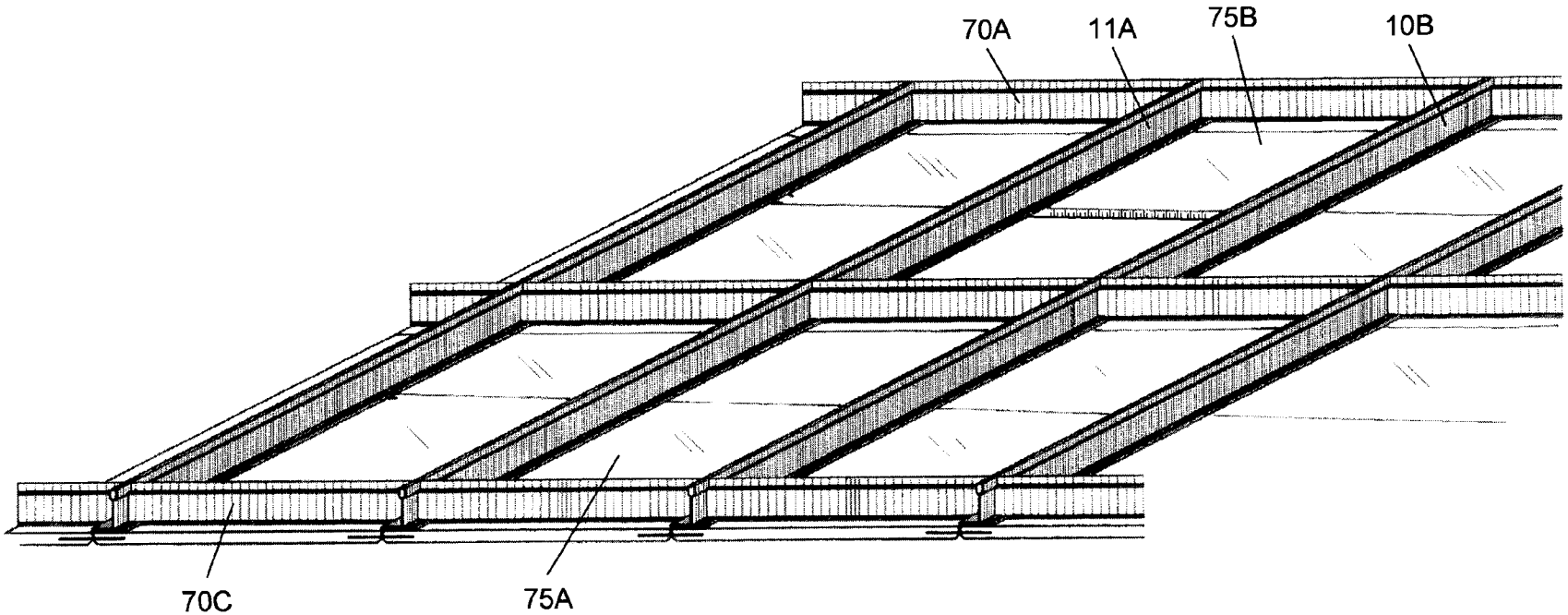
Figure 11D:
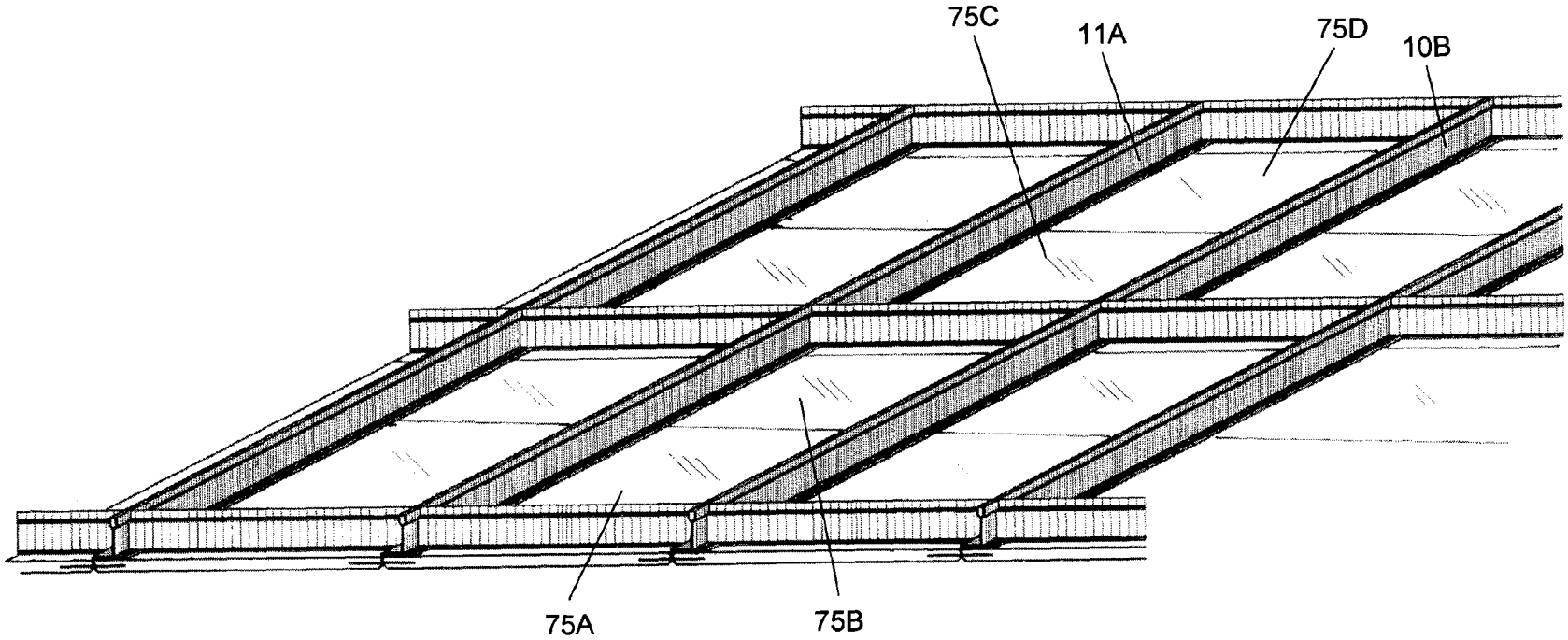

In FIG. 11C, panel 75A is then displaced to cross runner 70C while panel 75B is shown to be secured to main runners 11A and 10B adjacent to cross runner 70A. Panel 75B is then longitudinally displaced to be in abutting relation with panel 75A, as shown in FIG. 11D, whereupon panels 75C and 75D are also secured to runners 11A and 10B and longitudinally positioned adjacent to panel 75B.

Figure 12:
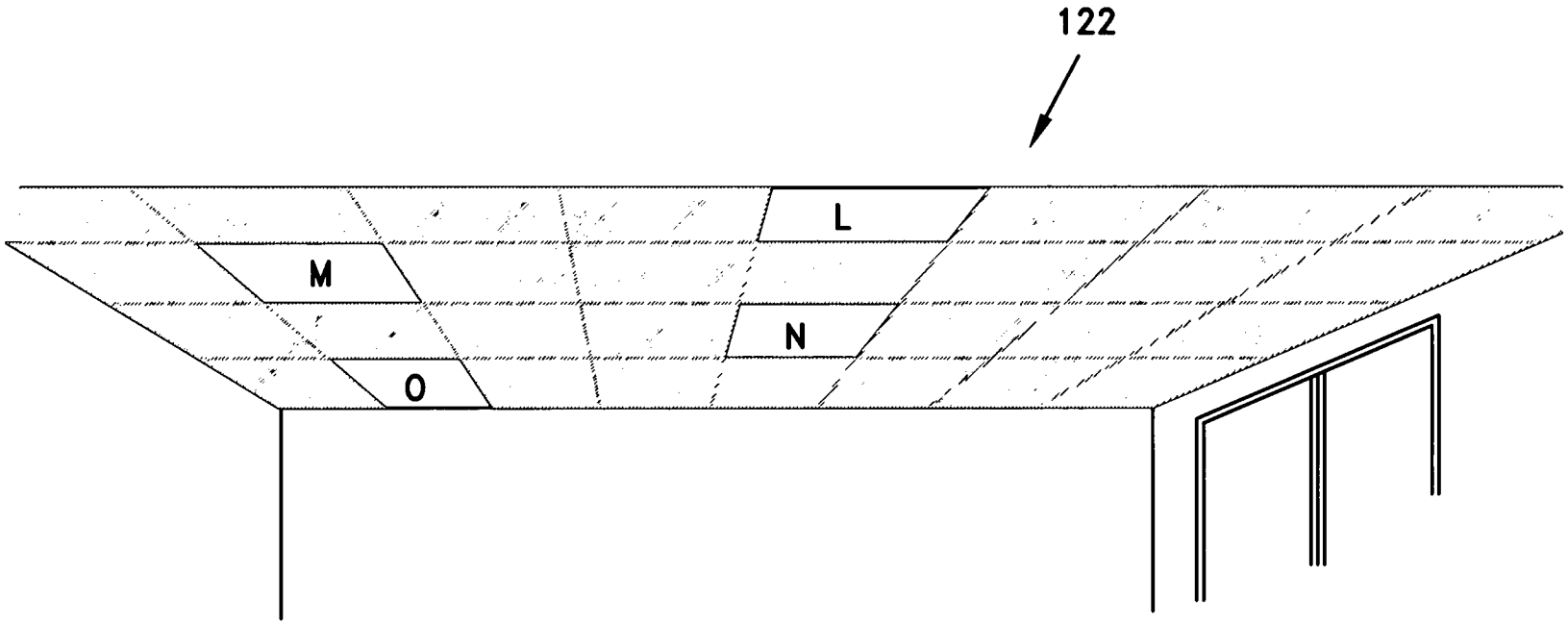
FIG. 12 is a perspective view from below of a panel system, showing an exemplary pattern that is formed from selectively displaced panel assemblies.

The panel assembly of the present invention employing a multi-directionally stiffening support section and a stabilizing support section advantageously remains secured to the main runners even though it is not positioned in abutting relation with an adjacent panel assembly. Thus a panel system 122 shown in FIG. 12 may be arranged according to any desired pattern, such as the illustrated pattern having void areas L-O.

Figure 13:
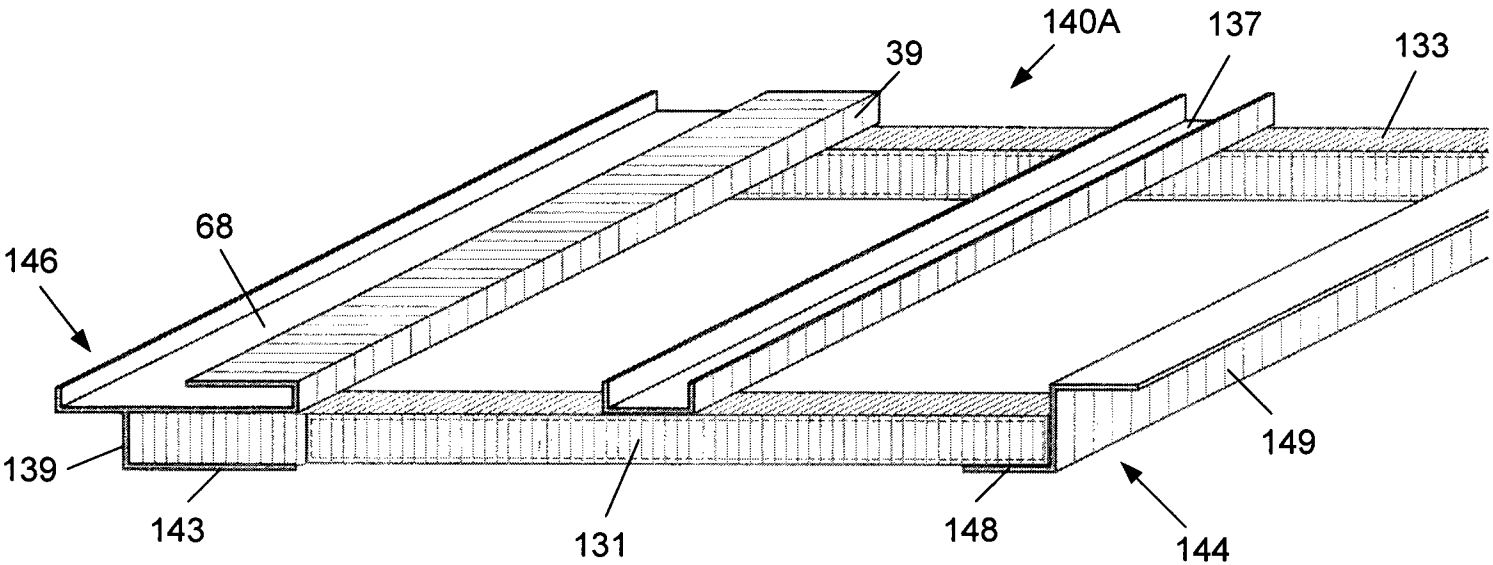
FIG. 13 is a perspective view from the side of a frame member which comprises connecting members attached to support sections similar to those of FIG. 3.

In the embodiment of FIG. 13, the panel assembly comprises a rectangular frame member 140A, e.g. a square frame member, having mutually parallel, laterally extending connecting members 131 and 133, e.g. of a rectangular cross section, which are both attached to stabilizing support section 144 and multi-directionally stiffening support section 146 configured similarly to support sections 64 and 66, respectively (FIG. 3). Alternatively, the stabilizing support section and multi-directionally stiffening support section may be of any desired configuration, for example similar to multi-directionally stiffening support section 76 shown in FIG. 5. At a first end, the connecting members are fitted between, and attached to, mutually parallel flange-underlying element 68 and bottom leg 143 of support section 146. A vertical spacer 139 abutting the first end of the connecting members and defining the width of the gap between adjacent panel assemblies 140 extends downwardly from a central portion of flange-underlying element 68 to one lateral end of bottom leg 143. Bottom leg 143 may laterally extend from spacer 139 to a region substantially underlying vertical element 39. At a second end, the connecting members are attached to the upper face of horizontal support element 148 laterally extending from vertical wall 149 of support section 144 towards support section 146. A cross member 137, e.g. of a U-shaped cross section, for strengthening the frame member is attached to approximately the centerline of connecting members 131 and 133.

To the frame member one or more visible, user selected panel sections are attachable, to produce a customized panel assembly.

Figure 14:
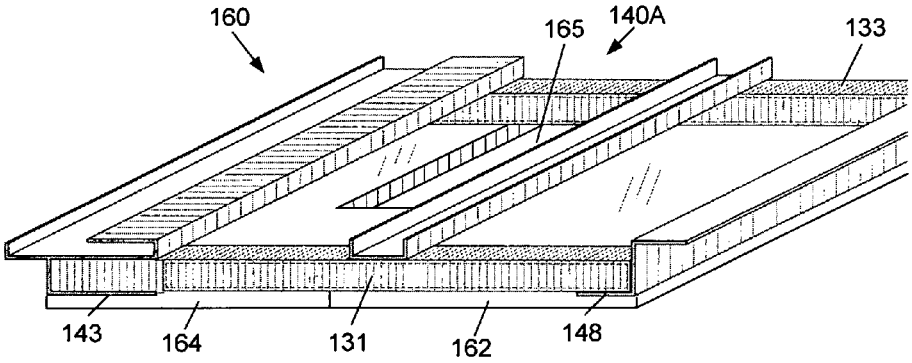
FIG. 14 is a perspective view from the side of a panel assembly comprising a rectangular panel section and an L-shaped panel section attached to the bottom of the frame member of FIG. 13.
Figure 15:
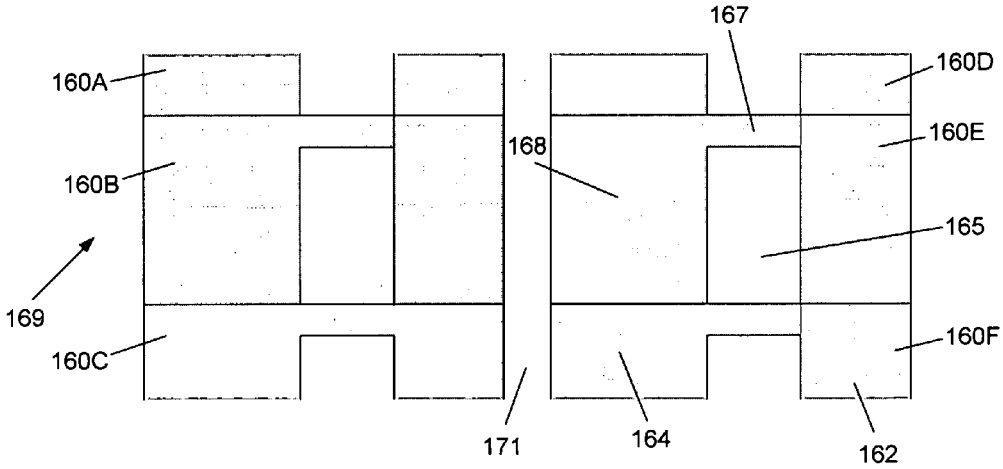
FIG. 15 is a bottom view of a panel system employing a plurality of panel assemblies of FIG. 14.

As shown for example in FIG. 14, a rectangular panel section 162 and an L-shaped panel section 164 are attached to the bottom of frame member 140A, i.e. to the bottom of connecting members 131 and 133, leg 143, and of support element 148, to produce panel assembly 160 having an opening 165. Wide region 167 of L-shaped panel section 164 is placed in abutting relation with rectangular panel section 162, while narrow region 168 thereof is spaced from the adjacent panel section 162 to define the opening 165, as further shown in FIG. 15. Panel sections 162 and 164 are suitably positioned so that they will be visible from an underlying floor surface and will conceal connecting members 131 and 133 and cross member 137.

Opening 165 constitutes an air chamber through which sounds generated in the room can be transmitted above panel assembly 160. Thus panel sections 162 and 164 may be made of inexpensive material that is not sound absorbing such as sheet metal or wood, yet panel assembly 160 is afforded good soundproofing qualities by which sounds will be transmitted through opening 165 and will not be reflected back into the room. In addition to the good soundproofing qualities, a panel system 169 employing the plurality of panel assemblies 160A-F is esthetically pleasing as the openings 165 centrally appear in each panel assembly in orderly fashion while a uniform gap 171 defined by the coplanar lateral edges of the adjacent panel rows is evident.

It will be appreciated that the frame member and the visible panel sections can be configured in any desired fashion insofar as the panel assembly is secured to a main runner flange and retained in a substantially horizontal disposition by its support sections. By use of a frame member that interfaces between a support section and a panel section, acoustical, decorative, and artistic effects may be achieved at a dramatically reduced cost that what could have realized heretofore. The frame member may support other ceiling related apparatus, including illumination elements, vents through which conditioned air can circulate, smoke detectors, and sprinklers. The one or more panel sections may be attached to the frame member by any means well known to those skilled in the art.

Figure 16:
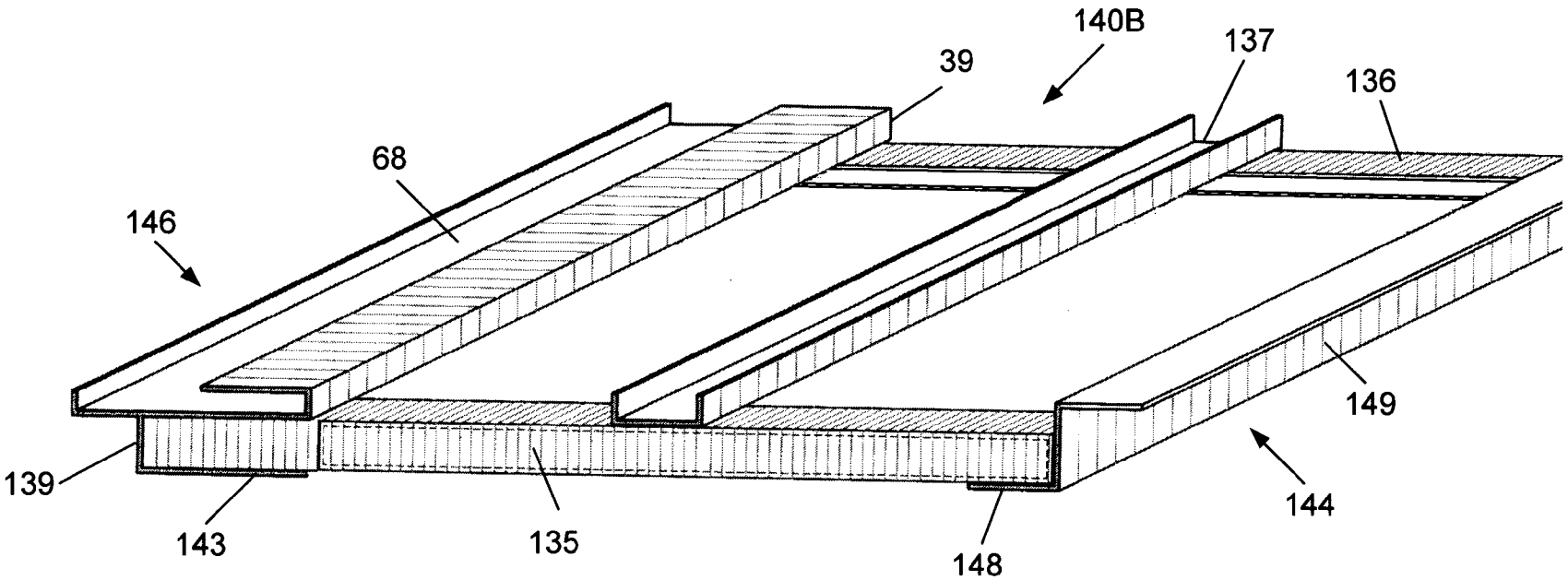
FIG. 16 is a perspective view from the side of another embodiment of a frame member.
Figure 17:
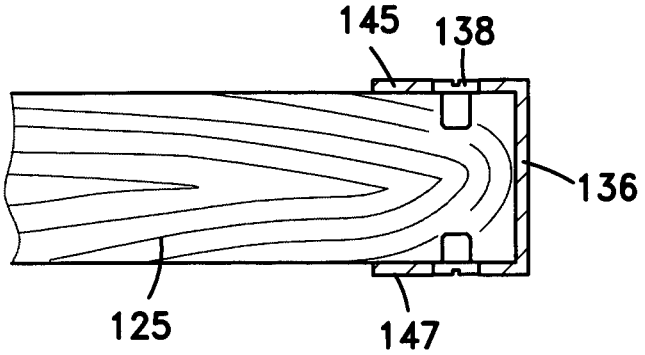
FIG. 17 is a longitudinal cross sectional view of a portion of a panel section attached to a connecting member of FIG. 16.

In the embodiment of FIG. 16, a frame member 140B may comprise connecting members 135 and 136 having a U-shaped cross section which faces the interior of the frame member. A panel section, e.g. wooden panel section 125, may be fitted between, and attached to, upper fin 145 and lower fin 147 of the connecting members, e.g. connecting member 136, by means of fasteners 147, as shown in FIG. 17.

Figure 18:
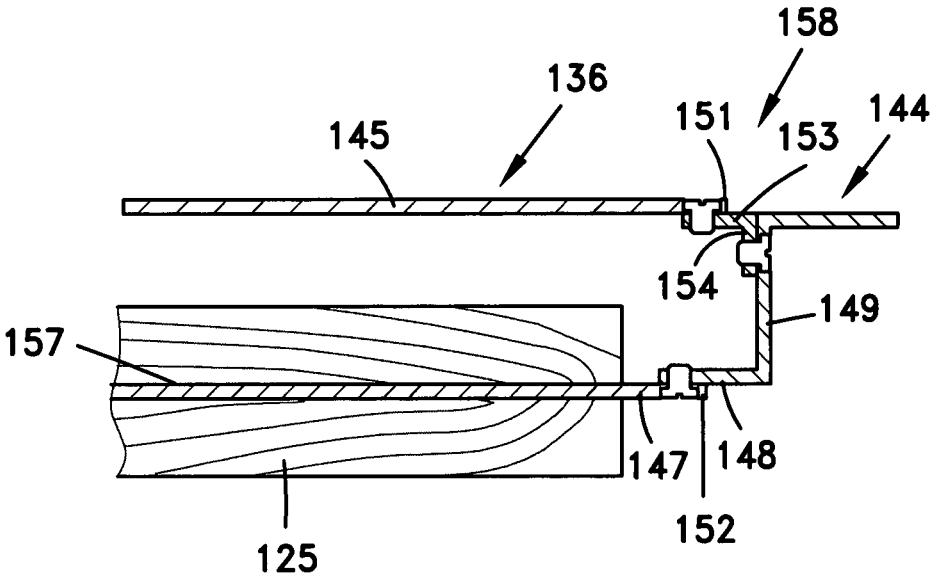
FIG. 18 is a lateral cross sectional view of a lateral end of a panel assembly according to another embodiment of the invention, showing a panel section frictionally engaged with a connecting member of FIG. 16 and a corner member interfacing the connecting member and the stabilizing support section.

Alternatively, a laterally extending slit 157 may be formed in the panel section 125 so as to be placed in engagement with e.g. lower fin 147 of connecting member 136, as shown in FIG. 18. Upper fin 145 of connecting member 136 at a lateral end 151 thereof may be connected to upper leg 153 of corner member 158, side leg 154 of which in turn is connected to vertical wall 149 of stabilizing support section 144. Horizontal support element 148 of support section 144 may be connected to lower fin 147 of connecting member 136 at lateral end 152 thereof.

Figure 19A:
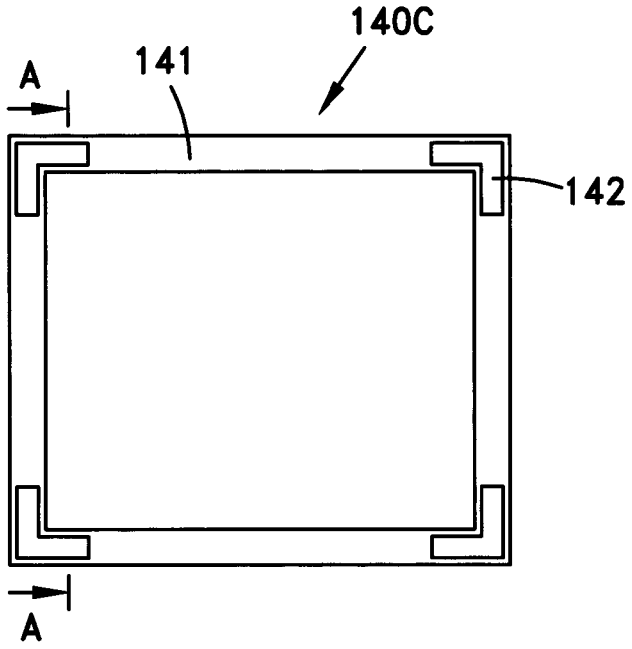
FIG. 19A is a plan view of a rectangular and integrally formed frame member and of four corner members for stiffening the frame member.
Figure 19B:
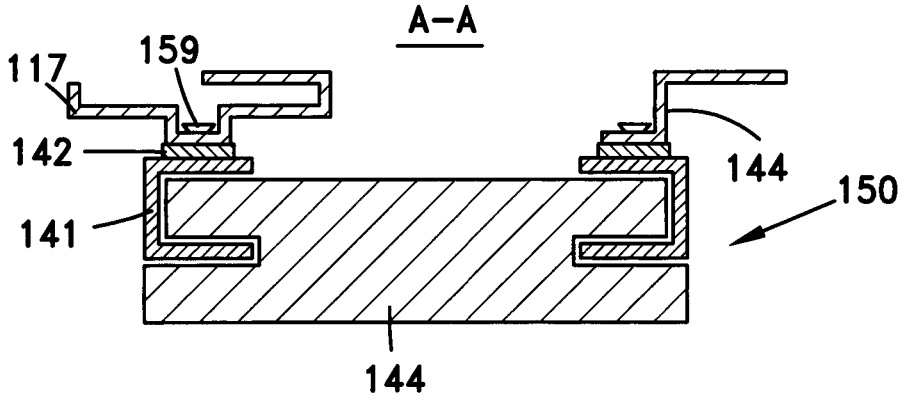
FIG. 19B is a cross sectional view of a panel assembly cur about plane A-A of FIG. 19A.

FIG. 19A illustrates a plan view of a frame member 140C comprising four integral connecting members 141, e.g. having a U-shaped cross section, to form a rectangular, e.g. square, frame member to which one or more visible, user selected panel sections are attachable. A corner member 142 connected to two adjacent connecting members 141 stiffens the frame member. FIG. 19B illustrates a panel assembly 150 that comprises a panel section 155 that is formed with slits so as to be coupled with the fins of connecting members 141 by a frictional fit. A single fastener 159 attaches each support section to a corresponding connecting member 141 and corner member 142 and to panel section 155.

Figure 20:
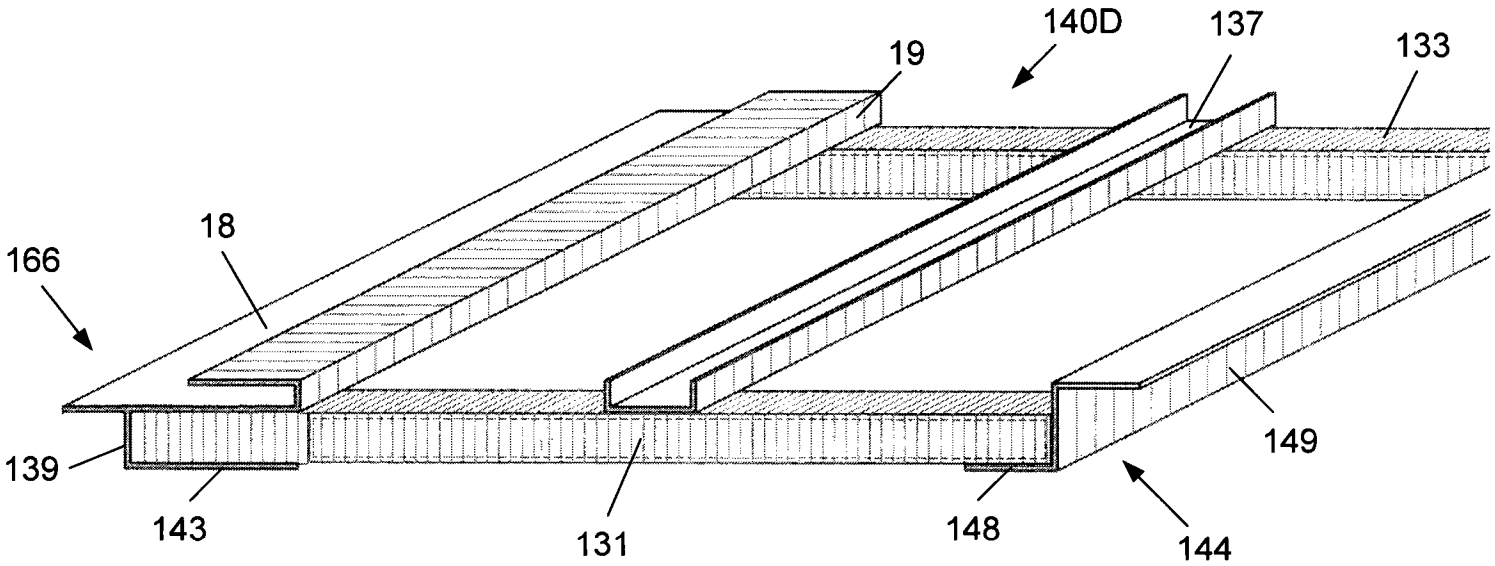
FIG. 20 is a perspective view from the side of another embodiment of a frame member.

A frame member 140D shown in FIG. 20 to which one or more visible, user selected panel sections are attachable may comprise, in addition to stabilizing support section 144, a support section 166 configured similarly to support section 16 of FIG. 1, i.e. with only one vertical element 19 extending from flange-underlying element 18 for contacting the main runner flange, or any other prior art support section for ceiling panels. Connecting members 131 and 133 may be similar to those of FIG. 13, similar to those of FIG. 16, or of any other desired configuration.

Figure 21:
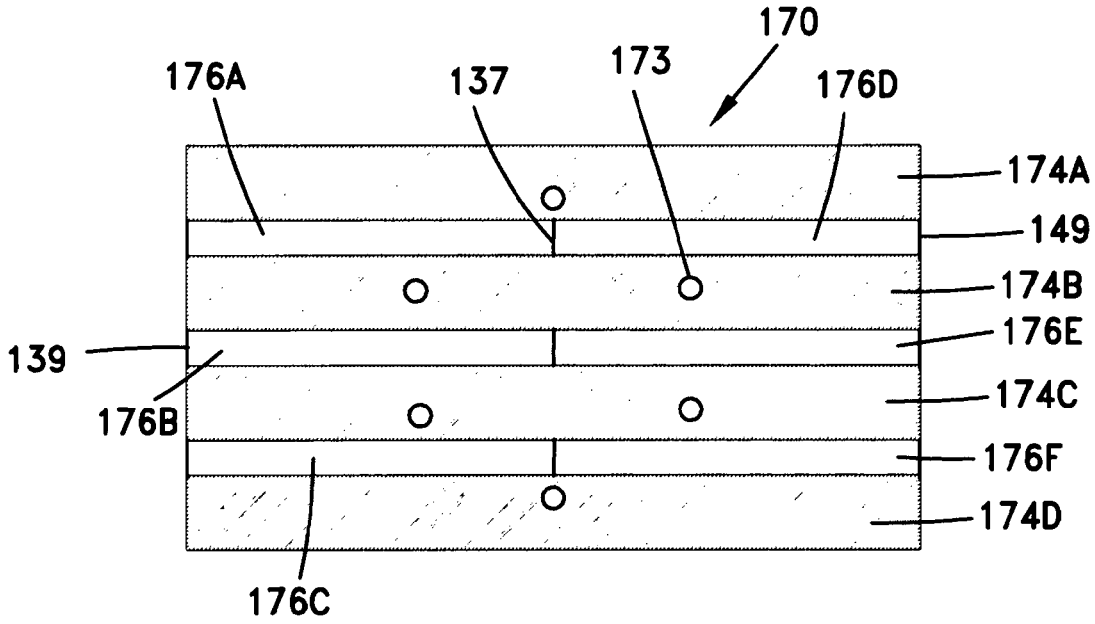
FIG. 21 is a bottom view of an exemplary panel assembly which comprises spaced panel sections provided with an arrangement of ornamental elements.

FIG. 21 illustrates an exemplary panel assembly 170 provided with ornamental elements attachable to any of the panel sections, to provide additional artistic or decorative effects. Four rectangular panel sections 174A-D are attached to the rectangular frame assembly to define sound transmitting air chamber openings 176A-F between two adjacent panel sections and between vertical spacer 139 of the multi-directionally stiffening support section and cross member 137, or between cross member 137 and vertical wall 149 of the stabilizing support section. A plurality of circular ornamental elements 173 are attached or applied to the panel sections to define a circular formation as shown. If so desired, a rectangular or any other shaped ornamental element may be employed.

Figure 22:
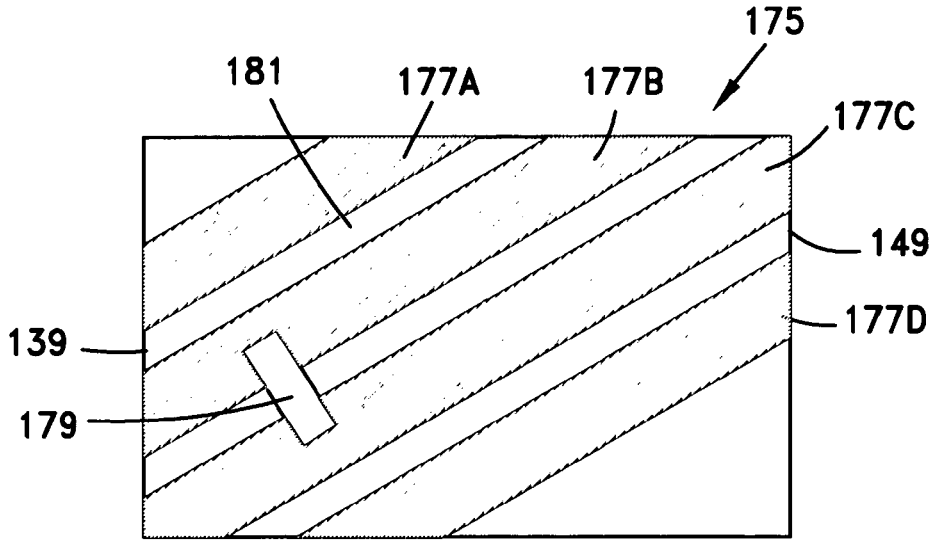
FIG. 22 is a bottom view of another exemplary panel assembly which comprises spaced panel sections provided with an ornamental element attached to two of the panel sections.

In FIG. 22, panel assembly 175 employs four mutually parallel panel sections 177A-D that are disposed obliquely with respect to vertical spacer 139 of the angularly locking support section and vertical wall 149 of the stabilizing support section. A rectangular ornamental element 179 is shown to be attached to both panel sections 177B and 177C. Although the frame member cross members overly air chamber openings 181 adjacent to each panel section, the cross members are not visible as the frame member may be covered by an acoustical fabric, e.g. one that is acoustically sound transparent. Alternatively, the visible frame portions may be painted black. Thus the visible frame portions will provide a shadowing effect and will harmonize with the remaining portions of the panel assembly.

Figure 23:
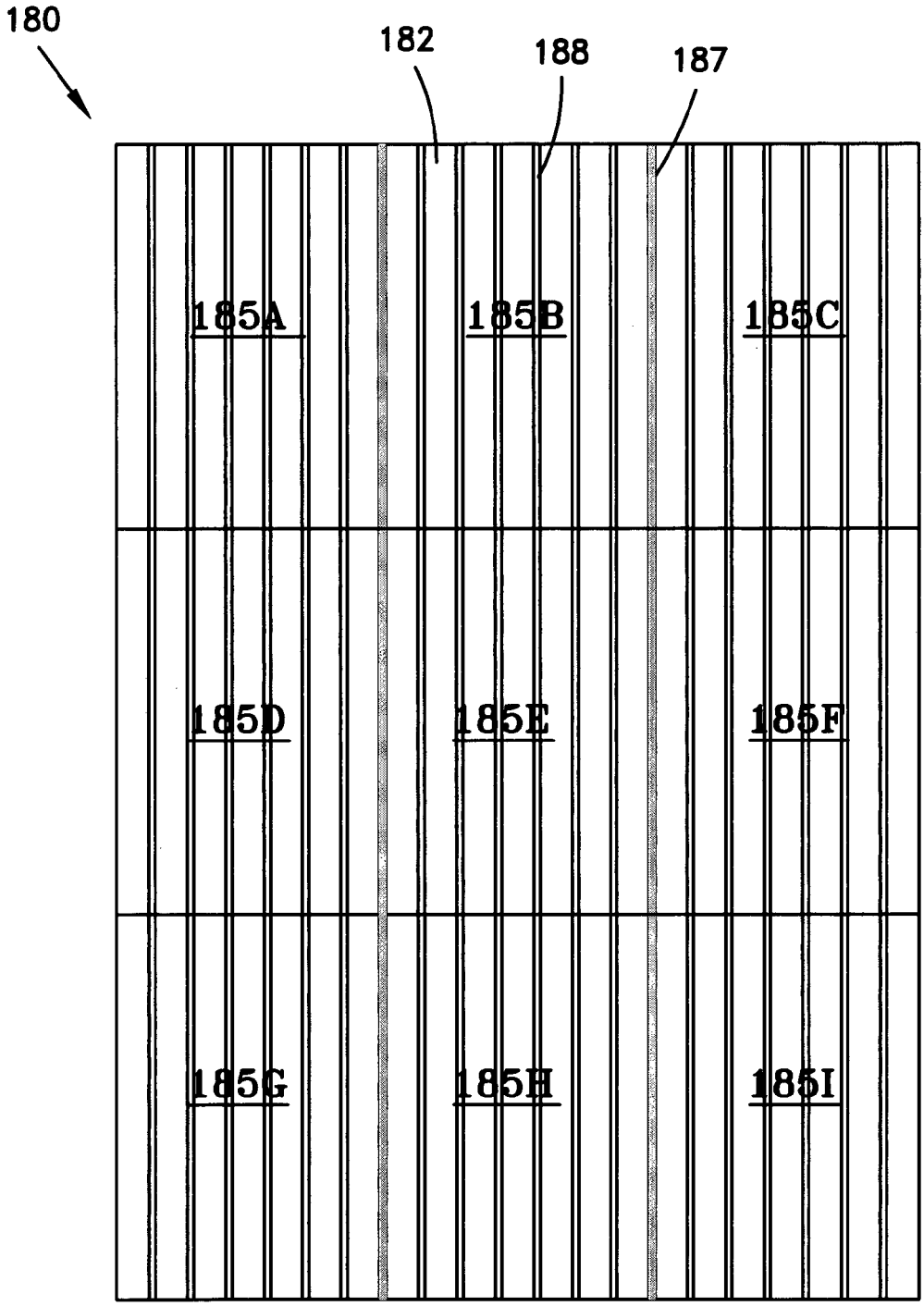
FIG. 23 is a bottom view of a panel system having a plurality of panel assemblies with spaced panel sections arranged such the gap between adjacent panel sections is of substantially the same width as the gap between adjacent panel assemblies.

FIG. 23 illustrates a panel system 180 comprising a plurality of a panel assemblies 185A-I, each of which having a plurality of parallel panel sections 182. The gap 188 between adjacent panel sections 182 is advantageously of substantially the same width as the gap 187 between adjacent panel assemblies, providing an architectural effect of a plurality of continuous gaps. An observer looking as the ceiling will have difficulty in differentiating between gaps 187 and 188.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A ceiling panel assembly for concealing a first main runner and for being secured to said first main runner and to a second main runner adjacent to, and laterally spaced from, said first main runner, wherein each of said first and second main runners is suspended, is inverted T-shaped, is longitudinally extending, and has a vertically disposed web, a horizontally disposed flange divided by said web to equal flange portions, and an oval protuberance at a terminal end of each of said flange portions, said panel assembly comprising:

a) a main section having an upper horizontal and substantially planar upper surface, first and second opposed lateral edges downwardly extending from said upper surface, and a bottom surface coinciding with one or more visible panel sections that are visible to a person located below said main section;

b) first and second support sections fixedly connected to said main section and laterally extending in opposite directions, said first and second support sections being disposed above said upper surface and said first and second lateral edges of said main section;

c) said first support section, comprising:

i) a planar flange-underlying element in unforcible contact with the first main runner flange;

ii) first and second vertically extending elements which vertically extend from said flange-underlying element and which are laterally spaced in first and second directions, respectively, from the web of said first main runner, for unforcibly contacting said protuberance of a corresponding flange portion of said first main runner from the side; and iii) an element substantially parallel to said flange-underlying element for unforcibly contacting said protuberance of a corresponding flange portion from above, wherein said first and second support sections releasably contact said first and second main runners, respectively, wherein said first support section is a multi-directionally stiffening support section for stiffening and unforcibly contacting in four different translational directions the flange of said first main runner which overlies the main section of said panel assembly, said four different translational directions including:

i) in said first direction, towards said first vertically extending element;

ii) in said second direction which is opposite to said first direction, towards said second vertically extending element;

iii) upwardly towards said element substantially parallel to said flange-underlying element; and iv) downwardly towards said flange-underlying element, wherein said second support section is a stabilizing support section for unforcibly contacting the flange of said second main runner which is multi-directionally stiffened by another panel assembly laterally spaced in said first direction from, and adjacent and identical to, said panel assembly, wherein the main section of said panel assembly is raisable above the flange of said first and second main runners, when being released therefrom.

2. The ceiling panel assembly according to claim 1, wherein the element substantially parallel to the flange-underlying element is a flange abuttable element for engaging a flange portion of the first main runner when the stabilizing support section is raised, to prevent the panel assembly from falling through a ceiling opening, wherein the multi-directionally stiffening support section is connected to the planar flange-underlying element, wherein one end of the flange-underlying element laterally extends from the first lateral edge of the main section.

3. The ceiling panel assembly according to claim 2, wherein the flange abuttable element extends from, and is substantially perpendicular to, one of the first and second vertically extending elements.

4. The ceiling panel assembly according to claim 1, wherein the flange-underlying element extends between the first and second vertically extending elements.

5. The ceiling panel assembly according to claim 1, wherein the first and second support sections are connected to the one or more panel sections and the flange-underlying element is in abutting relation with a planar upper surface of the one or more panel sections.

6. The ceiling panel assembly according to claim 1, wherein the length of the main runner flange is substantially equal to that of the flange-underlying element.

7. The ceiling panel assembly according to claim 1, wherein the multi-directionally stiffening support section is dimensioned such that one flange portion of the first main runner overlies the first lateral edge of the main section of said panel assembly and extends to the second lateral edge of another panel assembly which is laterally spaced in the second direction, and adjacent and identical to said panel assembly to define a gap between the first lateral edge of said panel assembly and the second lateral edge of said another panel assembly which is laterally spaced in the second direction from said panel assembly, wherein the first lateral edge of said panel assembly and the second lateral edge of said another panel assembly which is laterally spaced in the second direction from said panel assembly are straight edges and said gap has a predetermined and uniform width, and all first lateral edges of each of a row of said panel assemblies are essentially coplanar and all second lateral edges of each of a row of said another panel assemblies which are laterally spaced in the second direction from said panel assembly are essentially coplanar.

8. The ceiling panel assembly according to claim 7, wherein the gap has a width of less than 5 mm.

9. The ceiling panel assembly according to claim 1, wherein each of the one or more visible panel sections has a straight bottom edge and all bottom edges of each of a plurality of said panel assemblies are essentially coplanar.

10. The ceiling panel assembly according to claim 1, wherein the stabilizing support section comprises a force appliable element extending from the second lateral edge of said panel assembly and connected to the main section of said panel assembly, for unforcibly contacting one of the flange portion protuberances of the second main runner.

11. The ceiling panel assembly according to claim 10, wherein the force appliable element is substantially perpendicular to the web of the second main runner.

12. The ceiling panel assembly according to claim 1, wherein the main section further comprises a frame member to which the one or more visible panel sections are attachable, said frame member comprising one or more connecting members disposed below and fixedly connected to or integral with the first and second support sections.

13. The ceiling panel assembly according to claim 12, which is customizable and further comprises an ornamental element attached or applied to one or more of the panel sections.

14. The ceiling panel assembly according to claim 1, which is longitudinally slidable, when displaced, so as to pass below a plurality of spaced cross runners extending between the first and second main runners, without interference.

15. The ceiling panel assembly according to claim 3, wherein the element substantially parallel to the flange-underlying element is a flange abuttable element for engaging a flange portion of the first main runner when the stabilizing support section is raised, to prevent the panel assembly from falling through a ceiling opening, wherein the multi-directionally stiffening support section is integral with the planar flange-underlying element, wherein one end of the flange-underlying element laterally extends from the first lateral edge of the main section.

16. The ceiling panel assembly according to claim 15, wherein the multi-directionally stiffening support section is dimensioned such that one flange portion of the first main runner overlies the first lateral edge of the main section of said panel assembly and extends to the second lateral edge of another panel assembly which is laterally spaced in the second direction, and adjacent and identical to said panel assembly to define a gap between the first lateral edge of said panel assembly and the second lateral edge of said another panel assembly which is laterally spaced in the second direction from said panel assembly, wherein the first lateral edge of said panel assembly and the second lateral edge of said another panel assembly which is laterally spaced in the second direction from said panel assembly are straight edges and said gap has a predetermined and uniform width, and all first lateral edges of each of a row of said panel assemblies are essentially coplanar and all second lateral edges of each of a row of said another panel assemblies which are laterally spaced in the second direction from said panel assembly are essentially coplanar.

17. The ceiling panel assembly according to claim 1, wherein the multi-directionally stiffening support section unforcibly contacts the flange of the first main runner in a rotational direction about the protuberance which is spaced from the web of the first main runner in the first direction and towards the web of the first main runner.

18. A ceiling panel assembly for concealing a first main runner and for being secured to said first main runner and to a second main runner adjacent to, and laterally spaced from, said first main runner, wherein each of said first and second main runners is suspended, is inverted T-shaped, is longitudinally extending, and has a vertically disposed web, a horizontally disposed flange divided by said web to equal flange portions, and an oval protuberance at a terminal end of each of said flange portions, said panel assembly comprising:

a) a main section having an upper horizontal and substantially planar upper surface, first and second opposed lateral edges downwardly extending from said upper surface, and a bottom surface coinciding with one or more visible panel sections that are visible to a person located below said main section; and b) first and second support sections fixedly connected to said main section and laterally extending in opposite directions, said first and second support sections being disposed above said upper surface and said first and second lateral edges of said main section, c) said first support section, comprising:

i) a protuberance-fastening element having the same curvature as said protuberance, for unforcibly contacting substantially the entire outer surface of one of the flange portion protuberances which is spaced from the web of the first main runner in a first direction;

ii) a planar flange-underlying element in unforcible contact with the first main runner flange and tangentially and laterally extending from a first end of said protuberance-fastening element; and iii) a translation-limiting element substantially parallel to, and located above, said flange-underlying element, and laterally extending from a second end of said protuberance-fastening element by a discontinuity therebetween, in unforcible contact with the first main runner flange, wherein said first and second support sections releasably contact said first and second main runners, respectively, wherein said first support section is a multi-directionally stiffening support section for stiffening and unforcibly contacting in four different translational directions the flange of said first main runner which overlies the main section of said panel assembly, said four different translational directions including:

i) in said first direction, in cooperation with said protuberance-fastening element;

ii) in a second direction which is opposite to said first direction, in cooperation with said discontinuity;

iii) upwardly, in cooperation with said translation-limiting element and said discontinuity; and iv) downwardly, in cooperation with said flange-underlying element, wherein said second support section is a stabilizing support section for unforcibly contacting the flange of said second main runner which is multi-directionally stiffened by another panel assembly laterally spaced in said first direction from, and adjacent and identical to, said panel assembly, wherein the main section of said panel assembly is raisable above the flange of said first and second main runners, when being released therefrom.

19. The ceiling panel assembly according to claim 18, wherein the multi-directionally stiffening support section is dimensioned such that one flange portion of the first main runner overlies the first lateral edge of the main section of said panel assembly and extends to the second lateral edge of another panel assembly which is laterally spaced in the second direction, and adjacent and identical to said panel assembly to define a gap between the first lateral edge of said panel assembly and the second lateral edge of said another panel assembly which is laterally spaced in the second direction from said panel assembly, wherein the first lateral edge of said panel assembly and the second lateral edge of said another panel assembly which is laterally spaced in the second direction from said panel assembly are straight edges and said gap has a predetermined and uniform width, and all first lateral edges of each of a row of said panel assemblies are essentially coplanar and all second lateral edges of each of a row of said another panel assemblies which are laterally spaced in the second direction from said panel assembly are essentially coplanar.

20. A ceiling panel assembly for concealing a first main runner and for being secured to said first main runner and to a second main runner adjacent to, and laterally spaced from, said first main runner, wherein each of said first and second main runners is suspended, is inverted T-shaped, is longitudinally extending, and has a vertically disposed web, a horizontally disposed flange divided by said web to equal flange portions, and an oval protuberance at a terminal end of each of said flange portions, said panel assembly comprising:

a) a main section having an upper horizontal and substantially planar upper surface, first and second opposed lateral edges downwardly extending from said upper surface, and a bottom surface coinciding with one or more visible panel sections that are visible to a person located below said main section;

b) first and second support sections integral with said main section and laterally extending in opposite directions, said first and second support sections being disposed above said upper surface and said first and second lateral edges of said main section; and c) said first support section, comprising:

i) a planar flange-underlying element in unforcible contact with the first main runner flange;

ii) first and second vertically extending elements which vertically extend from said flange-underlying element and which are laterally spaced in first and second directions, respectively, from the web of said first main runner, for unforcibly contacting said protuberance of a corresponding flange portion of said first main runner from the side; and iii) an element substantially parallel to said flange-underlying element for unforcibly contacting said protuberance of a corresponding flange portion from above, wherein said first and second support sections releasably contact said first and second main runners, respectively, wherein said first support section is a multi-directionally stiffening support section for stiffening and unforcibly contacting in four different translational directions the flange of said first main runner which overlies the main section of said panel assembly, said four different translational directions including:

i) in said first direction, towards said first vertically extending element;

ii) in said second direction which is opposite to said first direction, towards said second vertically extending element;

iii) upwardly towards said element substantially parallel to said flange-underlying element; and iv) downwardly towards said flange-underlying element, wherein said second support section is a stabilizing support section for unforcibly contacting the flange of said second main runner which is multi-directionally stiffened by another panel assembly laterally spaced in said first direction from, and adjacent and identical to, said panel assembly, wherein the main section of said panel assembly is raisable above the flange of said first and second main runners, when being released therefrom.

* * * * *